US007843769B2

(12) United States Patent
Ishida et al.

(10) Patent No.: US 7,843,769 B2
(45) Date of Patent: Nov. 30, 2010

(54) WRIST WATCH, DISPLAY METHOD OF WRIST WATCH, AND PROGRAM

(75) Inventors: Naoto Ishida, Saitama (JP); Masafumi Hatanaka, Tokyo (JP); Eiji Kawai, Kanagawa (JP); Eriko Takeo, Tokyo (JP); Toshitake Mashiko, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/636,463

(22) Filed: Dec. 11, 2006

(65) Prior Publication Data

US 2007/0213955 A1 Sep. 13, 2007

(30) Foreign Application Priority Data

Dec. 14, 2005 (JP) ..... 2005-360010

(51) Int. Cl.
*G04C 17/00* (2006.01)
*G04B 19/00* (2006.01)

(52) U.S. Cl. ..... 368/82; 368/239

(58) Field of Classification Search ..... 368/82–84, 368/239, 240–242
See application file for complete search history.

(56) References Cited

U.S. PATENT DOCUMENTS

| | | | | |
|---|---|---|---|---|
| 6,339,429 | B1 * | 1/2002 | Schug | 345/589 |
| 6,449,219 | B1 * | 9/2002 | Hepp et al. | 368/16 |
| 6,593,901 | B1 * | 7/2003 | Kitazawa et al. | 345/4 |
| 6,714,486 | B2 * | 3/2004 | Biggs | 368/82 |
| 7,079,452 | B2 * | 7/2006 | Harrison | 368/82 |
| 7,394,725 | B2 * | 7/2008 | Bloch | 368/10 |
| 2005/0041536 | A1 * | 2/2005 | Lang | 368/223 |
| 2005/0156931 | A1 * | 7/2005 | Olchevski | 345/467 |
| 2005/0185519 | A1 * | 8/2005 | Kent | 368/239 |

FOREIGN PATENT DOCUMENTS

| | | |
|---|---|---|
| JP | 09-155025 | 6/1997 |
| JP | 11-155025 | 6/1999 |
| JP | 2002-202389 | 7/2002 |

* cited by examiner

*Primary Examiner*—Vit W Miska
*Assistant Examiner*—Sean Kayes
(74) *Attorney, Agent, or Firm*—Finnegan, Henderson, Farabow, Garrett & Dunner, L.L.P.

(57) ABSTRACT

An information processing device includes: timing means for performing a timing action thereby to output time information indicating the result of the timing action; unit time outputting means for converting the time, as indicated by the time information outputted from the timing means, into individual unit times, as expressed by using a plurality of time units individually, thereby to output the plural unit times individually; unit-by-unit contents decision means for individually deciding the unit presentation contents of an object to be presented to a user, individually for the plural time units, on the basis of such one of the plural unit times outputted from the unit time outputting means as is expressed by a target time unit; general contents decision means for deciding the general presentation contents of the object at the time which is indicated by the time information outputted from the timing means, on the basis of the unit presentation contents for every the time units decided by the unit-by-unit contents decision means; and presentation means for presenting the object with the general presentation contents decided by the general contents decision means.

20 Claims, 18 Drawing Sheets

FIG. 14

| FIRST CHANGING UNIT (FOUR SEASONS) | SPRING | SUMMER | AUTUMN | WINTER |
|---|---|---|---|---|
| BASE COLOR PARAMETER | 100 | 200 | 300 | 400 |

FIG. 15

| SECOND CHANGING UNIT (ONE HOUR) | CHROMA PARAMETER |
|---|---|
| 01 O'CLOCK | 01 |
| 02 O'CLOCK | 02 |
| 03 O'CLOCK | 03 |
| 04 O'CLOCK | 04 |
| 05 O'CLOCK | 05 |
| 06 O'CLOCK | 06 |
| 07 O'CLOCK | 07 |
| 08 O'CLOCK | 08 |
| 09 O'CLOCK | 09 |
| 10 O'CLOCK | 10 |
| 11 O'CLOCK | 11 |
| 12 O'CLOCK | 12 |
| 13 O'CLOCK | 13 |
| 14 O'CLOCK | 14 |
| 15 O'CLOCK | 15 |
| 16 O'CLOCK | 16 |
| 17 O'CLOCK | 17 |
| 18 O'CLOCK | 18 |
| 19 O'CLOCK | 19 |
| 20 O'CLOCK | 20 |
| 21 O'CLOCK | 21 |
| 22 O'CLOCK | 22 |
| 23 O'CLOCK | 23 |
| 24 O'CLOCK | 24 |

FIG. 16

| O'CLOCK | SPRING | SUMMER | AUTUMN | WINTER |
|---|---|---|---|---|
| | 100 | 200 | 300 | 400 |
| 01 | 101 | 201 | 301 | 401 |
| 02 | 102 | 202 | 302 | 402 |
| 03 | 103 | 203 | 303 | 403 |
| 04 | 104 | 204 | 304 | 404 |
| 05 | 105 | 205 | 305 | 405 |
| 06 | 106 | 206 | 306 | 406 |
| 07 | 107 | 207 | 307 | 407 |
| 08 | 108 | 208 | 308 | 408 |
| 09 | 109 | 209 | 309 | 409 |
| 10 | 110 | 210 | 310 | 410 |
| 11 | 111 | 211 | 311 | 411 |
| 12 | 112 | 212 | 312 | 412 |
| 13 | 113 | 213 | 313 | 413 |
| 14 | 114 | 214 | 314 | 414 |
| 15 | 115 | 215 | 315 | 415 |
| 16 | 116 | 216 | 316 | 416 |
| 17 | 117 | 217 | 317 | 417 |
| 18 | 118 | 218 | 318 | 418 |
| 19 | 119 | 219 | 319 | 419 |
| 20 | 120 | 220 | 320 | 420 |
| 21 | 121 | 221 | 321 | 421 |
| 22 | 122 | 222 | 322 | 422 |
| 23 | 123 | 223 | 323 | 423 |
| 24 | 124 | 224 | 324 | 424 |

WRIST WATCH, DISPLAY METHOD OF WRIST WATCH, AND PROGRAM

CROSS REFERENCES TO RELATED APPLICATIONS

The present invention contains subject matter related to Japanese Patent Application JP 2005-360010 filed in the Japanese Patent Office on Dec. 14, 2005, the entire contents of which being incorporated herein by reference.

BACKGROUND OF THE INVENTION

1. Field of the Invention

The invention relates to information processing device, method and program and, more particularly, to the information processing device, method and program, which are enabled to express the time not by resorting to expressions with needles or numerals but by the change in the presentation contents of an object.

2. Background Art

In the relevant art, there are a number of watches, which can be digitally displayed (as referred to JP-A-2002-202389 (Patent Document 1)). The display modes are so various as to include digitally displayed wrist watches. Of these digitally displayed watches, some wrist watches can display graphic images created by using a computer graphics function.

This wrist watch of the relevant art informs the user of the time as the absolute value of numerals by using either the positions indicated by hands displayed or the displayed numerals.

In the relevant art, moreover, there are known the pinball game machine (as referred to JP-A-9-155025 (Patent Document 2)), in which images according to the current rough time bands (e.g., morning, noon and night) are displayed as those for entertainment, or the image display control device (as referred to JP-A-11-155025 (Patent Document 3)), in which characters of animals or the like play a series of actions according to the current time.

SUMMARY OF THE INVENTION

However, the user has recognized the time numerically by utilizing the wristwatch of the relevant art. In this case, the time recognition mistake is caused by recognizing the numerals erroneously, e.g., by mistaken memories of numerals or forenoon and afternoon, or by confusions of numerals between the cases, in which the time is expressed by 24 hours and 12 hours. Moreover, the numerical information has only a meaning of the absolute value of the time so that it has to be related by the user himself when the absolute value is utilized in the life.

On the other hand, the images to be displayed by the pinball game machine of Patent Document 2 or the image display control device of Patent Document 3 is a playing image at best. Thus, there arise various problems including one, in which an identical image is displayed at the same time bands of different days. From these various problems, the user has been disabled to recognize the time intuitively even in view of those images or the time of a near future from the future prediction of the continuous image changes.

The invention has been conceived in view of such situations and contemplates to realize the time not by resorting to the expression of hands or numerals but by the change in the display contents of an object.

According to one embodiment of the invention, there is provided an information processing device including: timing means for performing a timing action thereby to output time information indicating the result of the timing action; unit time outputting means for converting the time, as indicated by the time information outputted from the timing means, into individual unit times, as expressed by using a plurality of time units individually, thereby to output the plural unit times individually; unit-by-unit contents decision means for individually deciding the unit presentation contents of an object to be presented to a user, individually for the plural time units, on the basis of such one of the plural unit times outputted from the unit time outputting means as is expressed by a target time unit; general contents decision means for deciding the general presentation contents of the object at the time which is indicated by the time information outputted from the timing means, on the basis of the unit presentation contents for every the time units decided by the unit-by-unit contents decision means; and presentation means for presenting the object with the general presentation contents decided by the general contents decision means.

An information processing device according to the embodiment, wherein unique parameter values are individually designated, for every the plural time units, to a plurality of contents to become the unit presentation contents of the object, and the information processing device further includes storage means for storing individual tables indicating corresponding relations for every the time units between the plural values which can become the unit times of the object time units, and the plural parameter values, wherein the unit-by-unit contents decision means acquires the parameter values corresponding, individually for the plural time units, to such one of the plural unit times outputted from the unit time outputting means as is expressed by a target time unit, individually from the individual tables stored in the storage means, and decides the parameter values for every the time units acquired, individually as the unit presentation contents for every the plural time units, and wherein the general contents decision means performs predetermined operations to use the parameter values for every the time units decided by the unit-by-unit contents decision means, and decides the operation results as the general presentation contents.

An information processing device according to the embodiment, wherein the object exists in plurality, wherein the unit-by-unit contents decision means and the general contents decision means execute individual operations on the plural objects, and wherein the presentation means presents the plural objects individually with the general presentation contents which are individually decided by the general contents decision means.

An information processing device according to the embodiment, wherein the plural objects are individually images, and wherein the presentation means presents one image having the plural objects as constituent elements.

An information processing device according to the embodiment, further including sensor means for measuring the level of the information processing device itself or the surrounding situations thereof, wherein at least one of the unit-by-unit contents decision means and the general contents decision means corrects the unit presentation contents or the general presentation contents in response to the level which is measured by the sensor means.

An information processing device according to the embodiment, further including communication means for communicating with another information processing device, wherein at least one of the unit-by-unit contents decision means and the general contents decision means corrects the unit presentation contents or the general presentation contents in response to the information which is obtained as a result of the communication with the another information processing device by the communication means.

According to another embodiment of the invention, there is provided an information processing method/program for an information processing device including timing means for performing a timing action thereby to output time information indicating the result of the timing action, and presentation means for presenting an object/adapted to be executed by a computer for controlling a device including the timing means and presentation means including the steps of: converting the time indicated by the time information outputted from the timing means, into unit times to be expressed by using a plurality of time units individually; deciding the unit presentation contents of an object to be presented to a user, individually for the plural time units, on the basis of such one of the plural unit times converted as is expressed by a target time unit; deciding the general presentation contents of the object at the time when the time information outputted from the timing means, individually on the basis of the unit presentation contents for the plural time units decided; and controlling the presentation of the object from the presentation means with the general presentation contents decided.

In information processing device, method and program according still another embodiment of the invention, the presented contents of an object by an information processing device including timing means for performing a timing action thereby to output time information indicating the result of the timing action, and presentation means for presenting an object/the contents of the object are controlled. More specifically, the time indicated by the time information outputted from the timing means is converted into unit times to be expressed by using a plurality of time units individually. The unit presentation contents of an object to be presented to a user are individually decided for the plural time units, on the basis of such one of the plural unit times' converted as is expressed by a target time unit. The general presentation contents of the object at the time when the time information outputted from the timing means are individually decided on the basis of the unit presentation contents for the plural time units decided. The object is presented from the presentation means with the general presentation contents decided.

Thus, according to the embodiments of the invention, it is possible to present the timed time to the user. Especially, it is possible to express the time with the change in the display contents of the object without resorting to the expression of hands or numerals.

BRIEF DESCRIPTION OF THE DRAWINGS

FIG. 14 is one example of a table to be stored in a parameter table storage unit of the main control unit of FIG. 13;

FIG. 15 is one example of a table to be stored in the parameter table storage unit of the main control unit of FIG. 13;

FIG. 16 is a diagram showing an example of parameter values, which can be the changing contents of objects to be decided according to the tables of FIG. 14 and FIG. 15;

DESCRIPTION OF THE PREFERRED EMBODIMENTS

Figure 1:
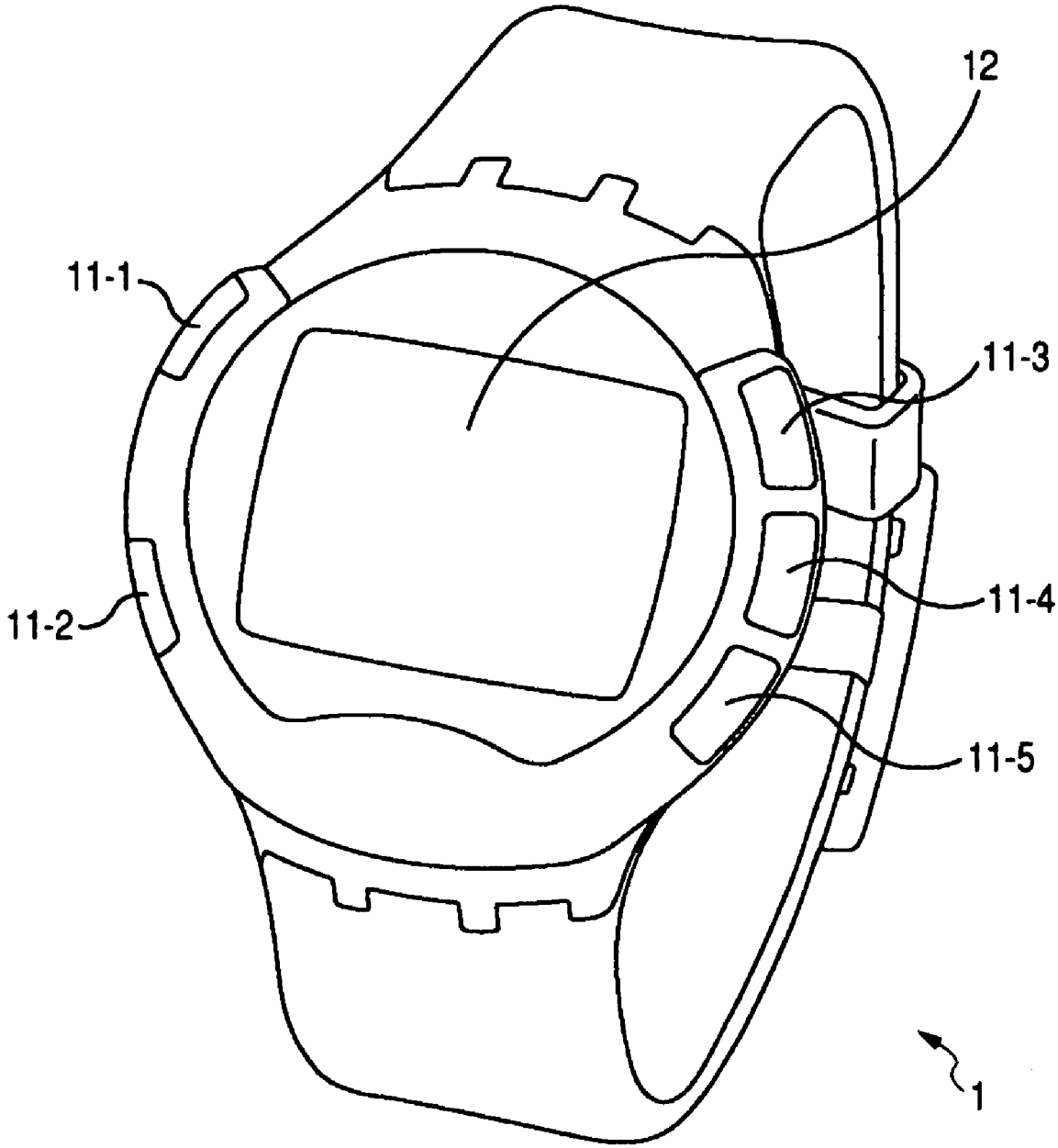
FIG. 1 is a diagram showing a constitution example of the appearance of a wrist watch according to an embodiment of the invention.

Embodiments of the invention are described in the following. The corresponding relations between the constituents of the invention and the embodiments, as described herein and in the drawings, are exemplified in the following. This description confirms that the embodiments supporting the invention are disclosed in the specification and the drawings. Therefore, even if there are embodiments disclosed in the specification or the drawings but not described herein as the embodiments corresponding to the constituents, it is not intended that the embodiments do not correspond to the constituents. Even if the embodiments are disclosed to correspond to the constituents, on the contrary, it is not meant that the embodiments do not correspond to the others of those constituents.

Figure 5:
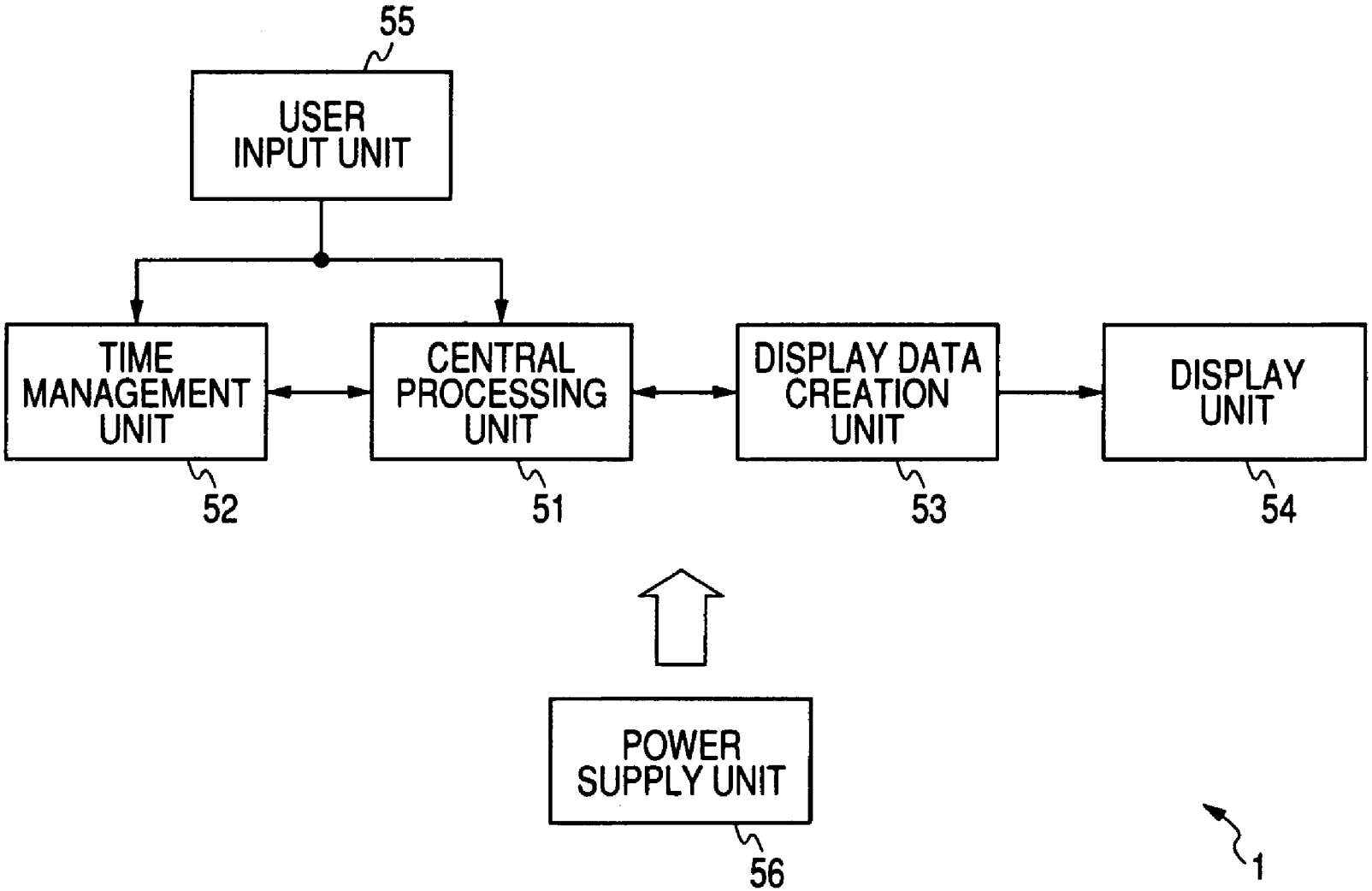
FIG. 5 is a functional block diagram showing an example of the functional constitution of the wrist watch of FIG. 1.
Figure 17:
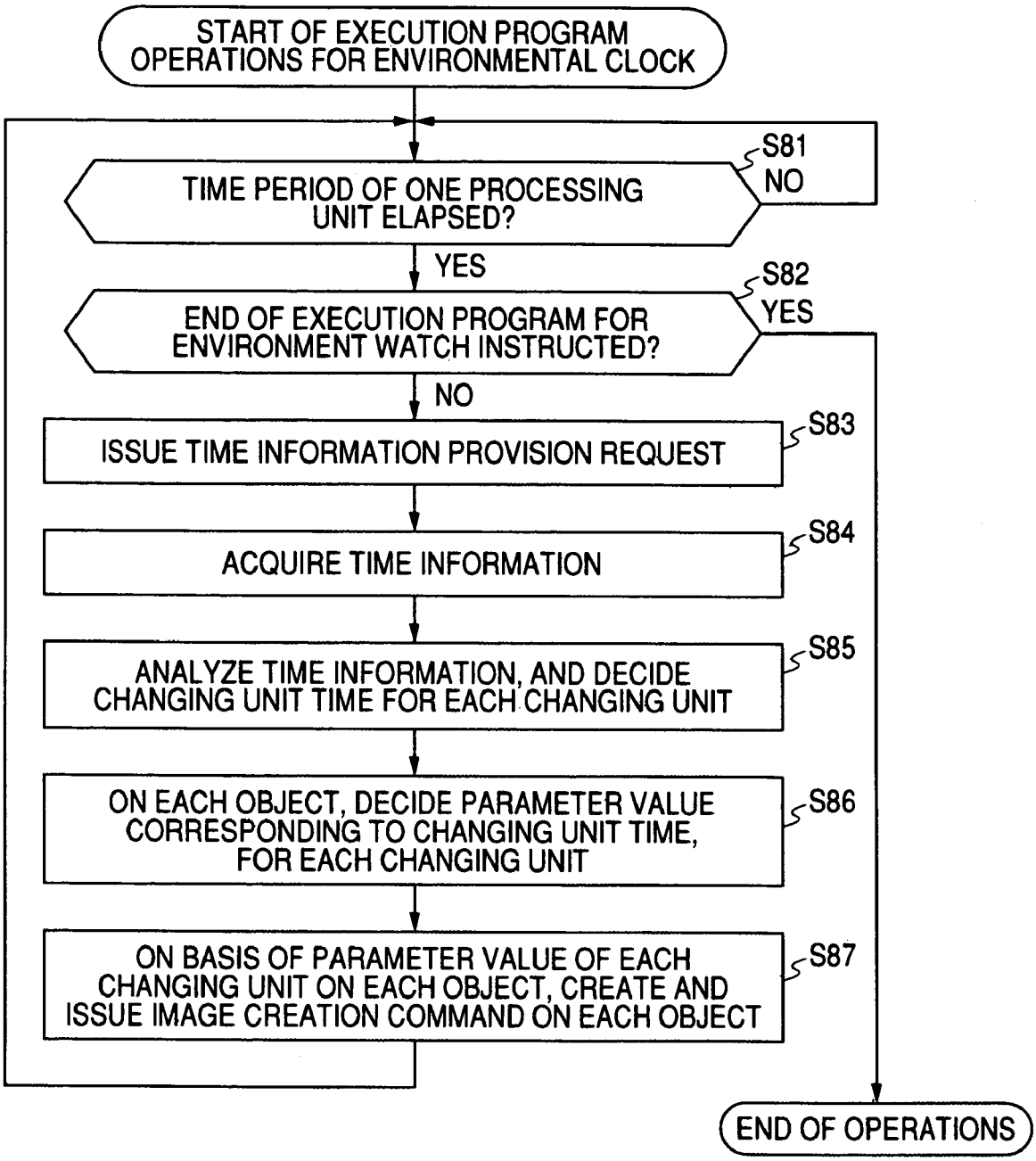
FIG. 17 is a flow chart for explaining one example of an execution program processing for the environment watch, which is executed by the main control unit having the functional constitution of FIG. 13.
Figure 18:
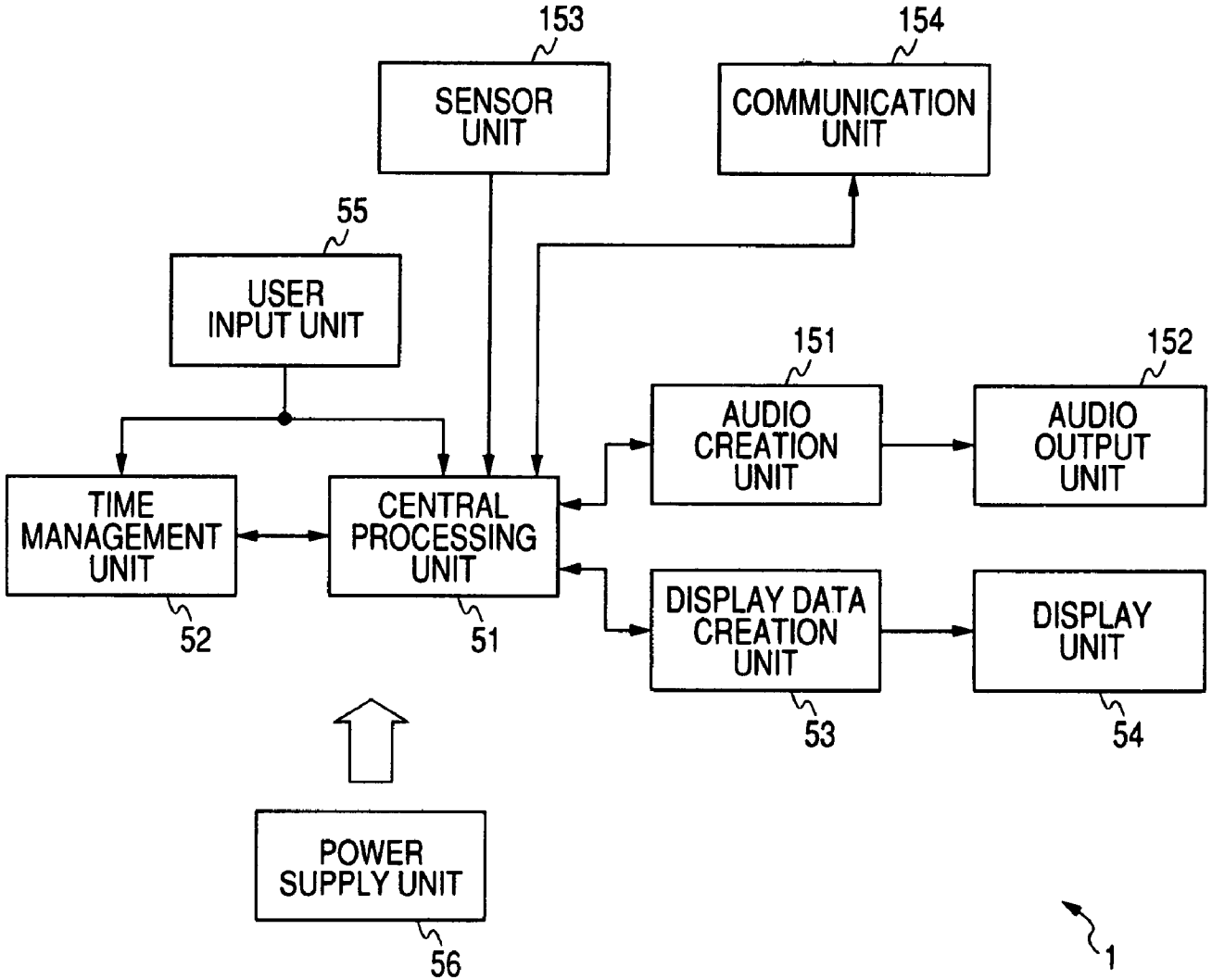
FIG. 18 is a functional block diagram showing an example of the functional constitution of the wrist watch according to an embodiment of the invention different from the example of FIG. 5.

According to one embodiment of the invention, there is provided an information processing device (e.g., a wrist watch 1 having a functional constitution of FIG. 5 or FIG. 18) including:

timing means (e.g., a time management unit 52 of FIG. 5 or FIG. 18) for performing a timing action thereby to output time information indicating the result of the timing action;

unit time outputting means (e.g., a time information analysis unit 102 of FIG. 13 in a central processing unit 51 of FIG. 5 or FIG. 18) for converting the time, as indicated by the time information outputted from the timing means, into individual unit times (i.e., the changing unit times, as called at Step S85 or the like of FIG. 17), as expressed by using a plurality of time units (e.g., the changing units, as called at Step S85 or the like of FIG. 17) individually, thereby to output the plural unit times individually;

unit-by-unit contents decision means (e.g., an image changing contents decision unit 103 of FIG. 13 of the central processing unit 51 of FIG. 5 or FIG. 18) for individually deciding the unit presentation contents (e.g., he base color painted on the mountain 89 at the changing unit of the "four seasons", as in the example of FIG. 14, or the chroma of the mountain 89 at the changing unit of the "one hour", as in the example of FIG. 15) of an object (e.g., a mountain 89 contained in the virtual space of FIG. 12) to be presented to a user, individually for the plural time units, on the basis of such one of the plural unit-times outputted from the unit time outputting means as is expressed by a target time unit;

general contents decision means (e.g., an image creation command issuing unit 105 of FIG. 13 of the central processing unit 51 of FIG. 5 or FIG. 18) for deciding the general presentation contents of the object at the time which is indicated by the time information outputted from the timing means, on the basis of the unit presentation contents for every the time units decided by the unit-by-unit contents decision means; and presentation means (e.g., a display data creation unit 53 and a display unit 54 of FIG. 5 or FIG. 18, and an audio creation unit 151 and an audio output unit 152 of FIG. 18) for presenting the object with the overall presentation contents decided by the general contents decision means.

An information processing device according to the embodiment, wherein unique parameter values are individually designated, for every the plural time units, to a plurality of contents to become the unit presentation contents of the object, further including storage means (e.g., a parameter table storage unit 104 of FIG. 13 of the central processing unit 51 of FIG. 5 or FIG. 18) for storing individual tables indicating corresponding relations for every the time units between the plural values which can become the unit times of the object time units, and the plural parameter values, wherein the unit-by-unit contents decision means acquires the parameter values corresponding, individually for the plural time units, to such one of the plural unit times outputted from the unit time outputting means as is expressed by a target time unit, individually from the individual tables stored in the storage means, and decides the parameter values for every the time units acquired, individually as the unit presentation contents for every the plural time units, and wherein the general contents decision means performs predetermined operations to use the parameter values for every the time units decided by the unit-by-unit contents decision means, and decides the operation results (e.g., any value of three FIGS. 101 to 424, as enumerated in the table of FIG. 16) as the general presentation contents.

Figure 12:
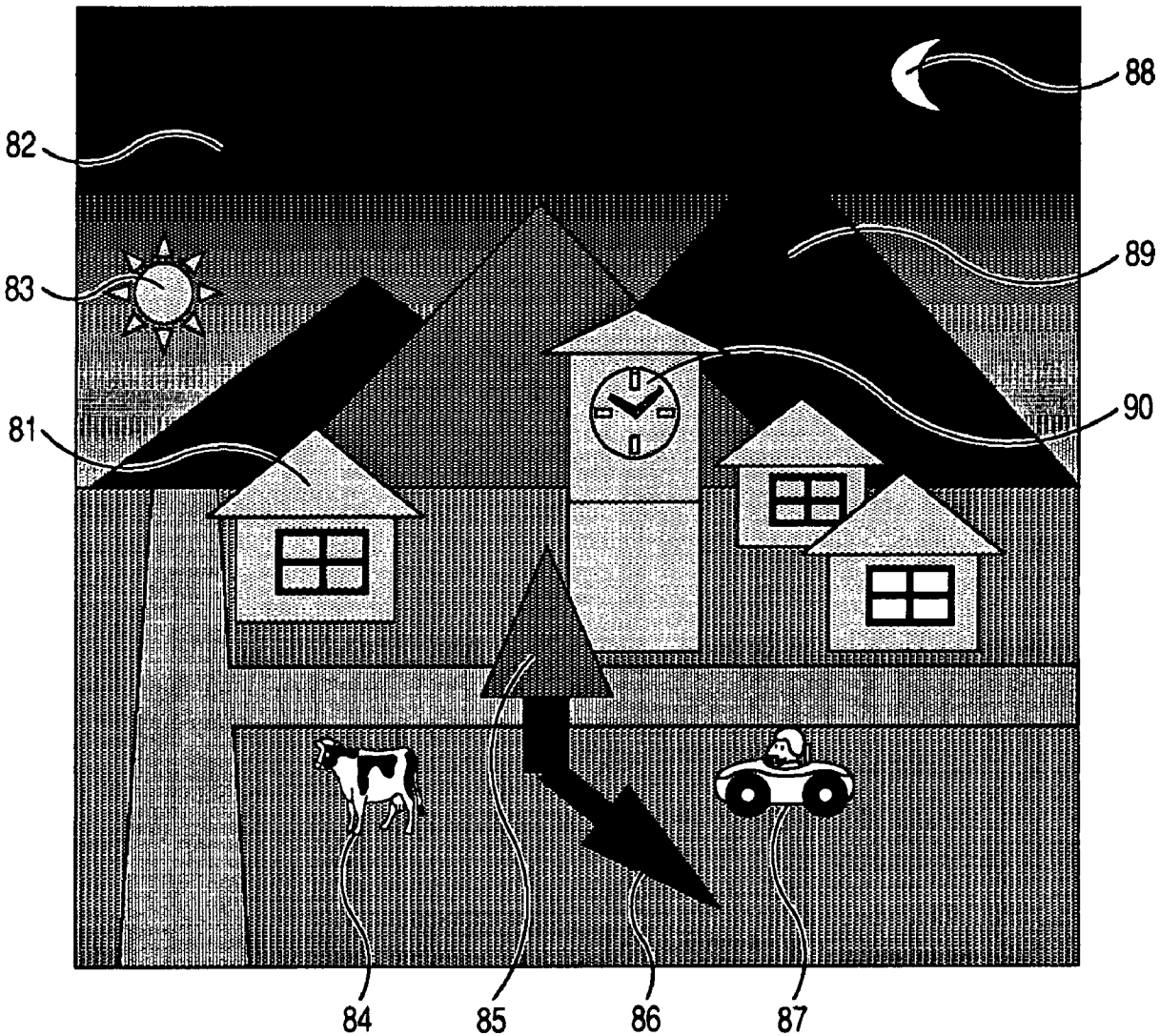
FIG. 12 is a diagram showing one example of an image, which is displayed in the LED of the wrist watch of FIG. 1 and so on by executing an execution program for an environment watch according to an embodiment of the invention.

An information processing device according to the embodiment, wherein the object exists in plurality (e.g., not only the mountain 89 but also the objects of a house 81 through a clock tower 90 exist in the example of FIG. 12), wherein the unit-by-unit contents decision means and the general contents decision means execute individual operations on the plural objects, and wherein the presentation means presents the plural objects individually with the general presentation contents which are individually decided by the general contents decision means.

An information processing device according to the embodiment, wherein the plural objects are individually images, and wherein the presentation means presents one image having the plural objects as constituent elements (e.g., an image showing a virtual space of FIG. 12 is displayed).

An information processing device according to the embodiment, further including sensor means (e.g., a sensor unit 153 of FIG. 18) for measuring the level of the information processing device itself or the surrounding situations thereof, wherein at least one of the unit-by-unit contents decision means and the general contents decision means corrects the unit presentation contents or the general presentation contents in response to the level which is measured by the sensor means.

An information processing device according to the embodiment, further including communication means (e.g., a communication unit 154 of FIG. 18) for communicating with another information processing device, wherein at least one of the unit-by-unit contents decision means and the general contents decision means corrects the unit presentation contents or the general presentation contents in response to the information which is obtained as a result of the communication with the another information processing device by the communication means.

According to another embodiment of the invention, there is provided an information processing method/program (e.g., an execution program for an environment watch, as will be described hereinafter) corresponding to the information processing device of the aforementioned embodiment of the invention, including the steps of:

converting (e.g., Step S85 of FIG. 17) the time indicated by the time information outputted from the timing means, into unit times to be expressed by using a plurality of time units individually;

deciding (e.g., Step S86 of FIG. 17) the unit presentation contents of an object to be presented to a user, individually for the plural time units, on the basis of such one of the plural unit times converted as is expressed by a target time unit;

deciding the general presentation contents of the object at the time when the time information outputted from the timing means, individually on the basis of the unit presentation contents for the plural time units decided; and controlling (e.g., Step S87 of FIG. 17) the presentation of the object from the presentation means with the general presentation contents decided.

An embodiment of the invention will be described with reference to the drawings.

FIG. 1 is a diagram showing a constitution example of the appearance of a wrist watch, to which the invention is applied.

In the example of FIG. 1, a wrist watch 1 is equipped, on such a face (shown in FIG. 1 and will be called the "surface"), with tact switches 11-1 to 11-5 for a (human) user to input various kinds of information (e.g., commands), as is observed by the user, when the wrist watch 1 is worn by the user. In the following, the tact switches 11-1 to 11-5 will be called together as the "tact switch 11" in case they need not be individually differentiated.

The wrist watch 1 is further equipped on its surface with a low-temperature polysilicone TFT (Thin Film Transistor) type LCD (Liquid Crystal Display) 12.

Figure 2:
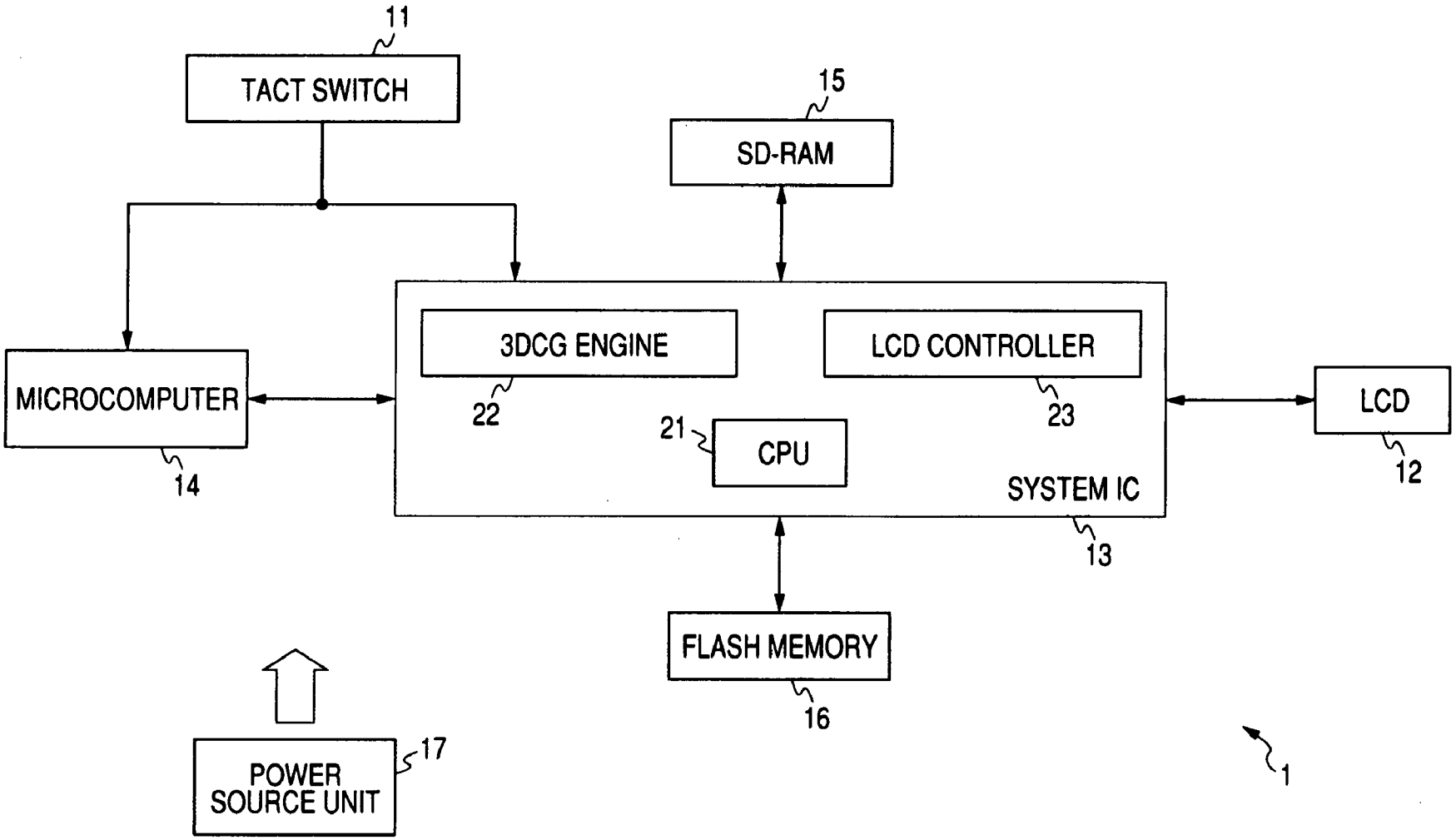
FIG. 2 is a block diagram showing an example of the hardware constitution of the wrist watch of FIG. 1.

FIG. 2 is a block diagram showing an example of the hardware constitution of the wrist watch 1 having the appearance constitution of FIG. 1.

In the example of FIG. 2, the wrist watch 1 is equipped with a system IC (Integrated Circuit) 13, a microcomputer 14, an SD-RAM (Synchronous Dynamic Random Access Memory) 15, a Flash Memory 16 and a power source unit 17 in addition to the aforementioned tact switch 11 and the LCD 12. The tact switch 11 is connected with the system IC 13 and the microcomputer 14. With the system IC 13, there are further connected the LCD 12, the microcomputer 14, the SD-RAM 15 and the Flash Memory 16.

The system IC 13 is equipped with a CPU (Central Processing Unit) 21, a 3DCG engine 22 and an LCD controller 23.

The CPU 21 executes various kinds of operations in accordance with various kinds of programs (e.g., the control programs of the 3DCG engine 22) loaded from the Flash Memory 16 into the SD-RAM 15. As a result, the entire operations of the wrist watch 1 are controlled. The SD-RAM 15 is also suitably stored with data necessary for the CPU 21 to execute the various kinds of operations.

On the basis of the control (or command) of the CPU 21, the 3DCG engine 22 creates and feeds the graphic data to the LCD controller 23.

In this embodiment, to the 3DCG engine 22, there is applied the three-dimensional computer graphics (3DCG) method using the curved-face architecture. In other words, the 3DCG engine 22 of the present embodiment realizes the curved-face architecture in a hardware manner.

Here, the 3DCG method to be applied to the 3DCG engine 22 is the 3DCG method (as will be called the "curved-face architecture method") using the curved-face architecture in this embodiment. However, the 3DCG method should not be limited thereto but may be another 3DCG method such as the 3DCG method using a polygon (as will be called the "polygon method").

However, the following difference exists between the polygon method and the curved-face architecture method. Therefore, the curved-face architecture method is preferred for this embodiment as the 3DCG method to be adopted in the 3DCG engine 22.

In the polygon method, specifically, a point is expressed as coordinates (X, Y, Z) having three values X, Y and Z. Moreover, a plane is formed by connecting one or more point. This plane is called the "polygon". Specifically, the polygon means a polygonal shape and may have any angles if it is a plane. However, a face defined by three apexes (i.e., a triangle) is verified to be a plane and is conveniently handled in computers. Thus, a triangle is frequently used as the polygon. In the polygon method, various objects are formed by combining one or more polygon.

However, the polygon is a plane (or a polygonal shape) so that it cannot express a curved face as it is. In order to express the curved face by the polygon method, therefore, it is necessary to make the polygon finer and finer, i.e., to use many polygons. To use many polygons is to elongate the operation time period accordingly. This use is not practical even in case it is intended to realize a smooth curved face. Therefore, a method for causing the shadows to appear to change gently may be used to make a proper number of polygons seen to have no angles at the joints of faces. However, this method resorts to only the appearances so that the object formed by this method presents the angles at its contour. These angles become more apparent when the object is enlarged.

In the curved-face architecture method, on the contrary, the object is expressed by using a unit, as called the patch having sixteen control points. These control points are individually expressed by coordinates (X, Y, Z) having three values X, Y and Z as in the case of the polygon method. In the curved-face architecture method, however, unlike the polygon method, a control point and a control point are interpolated by a smooth curve. In order to express a smooth curved face, therefore, the number of polygons or polygonal shapes (e.g., triangles) has to be increased in the polygon method, but the curved face can be simply expressed in the curved-face architecture method without increasing the number of patches. As a result, the curved-face architecture method can realize the smooth curve with drastically less data quantity than that of the polygon method.

Figure 3:
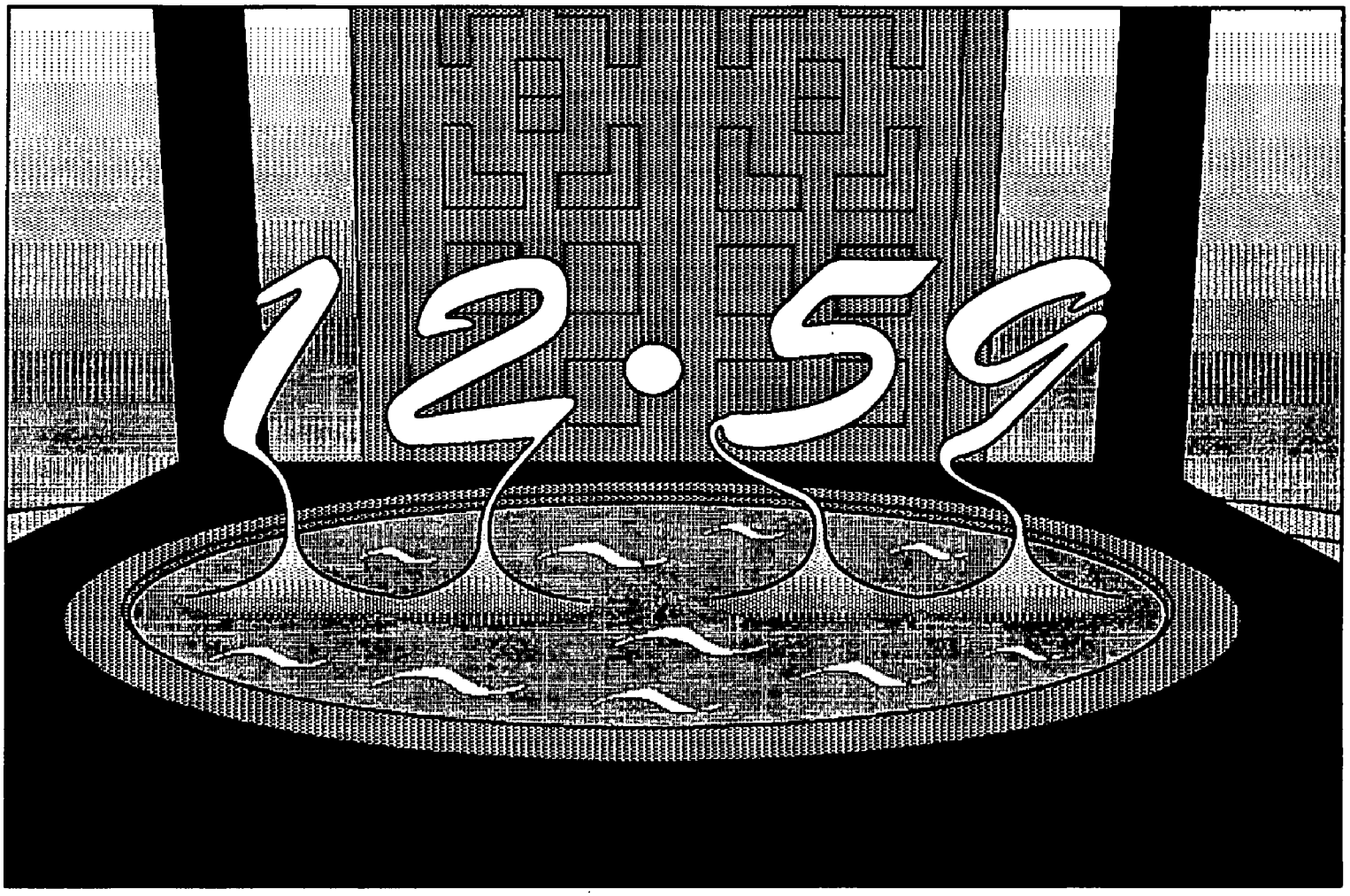
FIG. 3 is a view showing an example of a graphic image displayed in the wrist watch of FIG. 1.

For example, specifically, FIG. 3 shows one example of the 3DCG image created by the curved-face architecture method, that is, one example of the graphic image corresponding to the graphic data created by the 3DCG engine 22 (FIG. 2) of this embodiment. Thus in this embodiment, the graphic image, as shown in FIG. 3, that is, the 3DCG image of a high quality, in which individual objects such as numerals indicating the time are expressed in smooth curved faces, can be displayed in the LCD 12.

Here, the polygonal shape (or polygon) such as a triangle in the polygon method has only three apexes, but the patch needs sixteen control points. Because of this data structure, the polygon method apparently seems to have a less data quantity than that of the curved-face architecture method. As a matter of fact, however, the discussion is reversed such that the curved-face architecture method has a far less data quantity than the polygon method. This is because the numbers of data necessary for expressing a curve are different.

Thus, the curved-face architecture method has a first feature that it has less data so that it can easily control the deformation of an object. The second feature of the curved-face architecture method is that the control point and the control point are interpolated to have a smooth curved face, even if enlarged.

Thanks to this first feature, the curved-face architecture method becomes more advantageous than the polygon method in case the object is processed in the 3DCG as the object becomes the more complicated. In the case of the polygon method, more specifically, the number of polygons has to be made the larger when the more complicated object is to be expressed. As a result, the data to be processed is increased so that the burden on the processing is raised to lead to a delay in the processing speed in dependence upon the performance of the processor. On the contrary, the curved-face architecture method is featured by the less data for expressing the curved face, and the data quantity is not increased even when the object is complicated. Even if the object to be expressed is complicated, therefore, the burden on the processing is hardly increased to take an advantage over the polygon method.

Moreover, the second feature of the curved-face architecture method leads as it is to the merits to facilitate the enlargement/reduction of the 3D object. Specifically, two kinds of model data have to be prepared by using the polygon method to zoom the object. As has been described hereinbefore, the polygon method has the disadvantage that the angular appearance of the model becomes prominent if enlarged. In the 3DCG using the polygon method, therefore, two images of a standard image and an enlarged image are prepared to suppress the angular appearance even if enlarged. In the enlarging case, it is necessary to execute a processing to make a change to the enlarged image. In an application needed to enlarge the object, therefore, the data size of the model is doubled. Moreover, the standard image and the enlarged image have to be interchanged without any abnormal feel. On the contrary, the curved-face architecture method has the second advantage that the image is smooth even if enlarged. This advantage leads to the merit that the enlargement/reduction can be realized without increasing the data quantity or interchanging the images. This merit can be the remarkably effective when the user intends to enlarge and confirm the display contents in a device such as a wrist watch having a relatively small display screen.

The curved-face architecture method has such first and second advantages so that it can realize the morphing effects easily. This morphing is either the effect to change the two images (i.e., the first image and the second image), as designed in advance by using the patches, gradually from the first image to the second image by moving the control points of the two images, or the method for realizing that effect. The 3DCG engine 22 (FIG. 1) of this embodiment realizes the morphing such that the intermediate point is automatically interpolated by setting each control point of the first image as the starting point and by setting each control point of the second image as the ending point. At this, time the number of intermediate points to be interpolated and the changing time from the starting point to the ending point are decided by the control programs.

Figure 4:
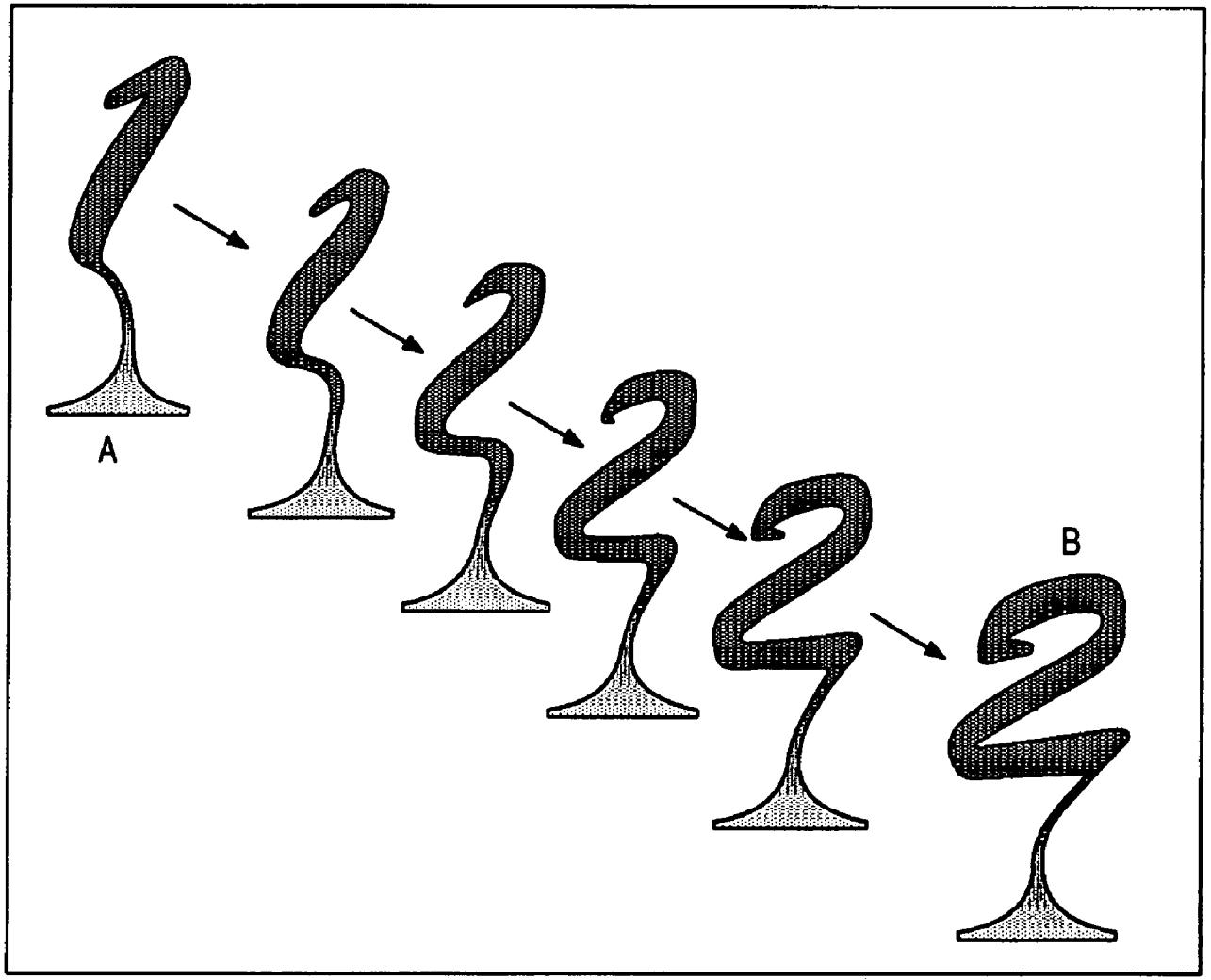
FIG. 4 is a diagram for explaining a morphing.

More specifically, as shown in FIG. 4, the 3DCG engine 22 (FIG. 2) of this embodiment performs the control of the display using the morphing to deform the numeral indicating the time gradually as the time passes, i.e., in the example of FIG. 4, the control of the display using the morphing to deform one numeral indicating the time, "1" indicated by a first image A, gradually to a numeral "2" indicated by a second image B. As a result, the digital display of the time using the morphing can be realized as the time display of the LCD 12.

Moreover, the curved-face architecture method has a third advantage that the data compression ratio is made excellent by using the patches. Therefore, the image data, as prepared by using the curved-face architecture method, can be compressed by a compression method such as the ZIP to about one sixth of the data before compressed.

In the wrist watch 1 of this embodiment, as has been described hereinbefore, the curved-face architecture method having the aforementioned first to third advantages is applied. As compared with the case in which another 3DCG method (e.g., the polygon method) is applied, the 3DCG image of high fineness can be displayed with a drastically smaller data size.

Moreover, it contributes to the reduction of a power consumption necessary for the image formation that the data size to be used in the curved-face architecture method is small.

Because of the small data size, it is possible to reduce the number of times for transferring the data from the memory (e.g., the SD-RAM 15 or the Flash Memory 16 in the example of FIG. 2) to the 3DCG engine (e.g., the 3DCG engine 22 in the example of FIG. 2). It is also possible to reduce the load on the CPU (e.g., the CPU 21 in the example of FIG. 2) for performing the processing for image formations. By applying the curved-face architecture method, therefore, the power consumption can be made lower than that of the case of applying another 3DCG method.

Moreover, the 3DCG engine 22 of this embodiment realizes the curved-face architecture in the hardware manner, as has been described hereinbefore. This realization of the 3DCG engine in the hardware manner makes a high contribution to the reduction in the power consumption. This is because the software realization of the same processing complicates the processing to require the electric power far more. It could be the that the power reducing effect is enhanced by realizing the curved-face architecture in such a device in the hardware manner that the power consumption is limited not only in the wrist watch 1 of this embodiment but also an ordinary wrist watch which can use the power only in a limited quantity so that it has to elongate the use of the limited power.

Reverting to FIG. 2, the LCD controller 23 controls the display of the LCD 12. Specifically, the LCD controller 23 converts the graphic data fed from the 3DCG engine 22, if desired, into the mode suited for the LCD 12, and transfers the converted data to the LCD 12. As a result, the LCD 12 displays the graphic image corresponding to the graphic data, such as the 3DCG image for displaying the time, as shown in FIG. 3. When the time changes, moreover, the 3DCG image (or moving image), as its time indicating numerals are gradually changed by the morphing, as shown in FIG. 4, is displayed in the LCD 12.

The microcomputer 14 has an oscillation circuit or a counter built therein, although not shown, and ticks the time on the basis of the set time so that it provides the system IC 13, if necessary, with the information (as will be called the time information) indicating the current time.

The power source unit 17 is composed of a lithium ion secondary battery, a charge controller and a power source regulator, for example, although not shown, thereby to supply such power sources (or electric powers) as are necessary for the aforementioned individual blocks (or individual modules) constituting the wrist watch 1. Here in FIG. 2, the various lines for supplying the power sources individually to the individual blocks are shown altogether as a blanked arrow so as to prevent the illustration from being complicated.

The hardware constitution example of the wrist watch 1 has thus far been described with reference to FIG. 2.

However, the hardware constitution of the wrist watch 1 should not be limited to the example of FIG. 2 but may be any, if it has the functional constitution of FIG. 5, as is described in the following.

Specifically, FIG. 5 is a functional block diagram showing the example of the functional constitution of the wrist watch 1.

The central processing unit 51 controls the entire operation of the wrist watch 1. Here, the detailed constitution example of the central processing unit 51 and the processing example of the central processing unit 51 will be described with reference to FIG. 6 and FIG. 10, respectively.

The time management unit 52 is constituted of the microcomputer 14, in case the wrist watch 1 has the hardware constitution of FIG. 2. Therefore, the function owned to the time management unit 52 is similar to the aforementioned one owned by the microcomputer 14, so that its description is omitted. Moreover, a processing example to be realized by the function owned by the time management unit 52 will be described with reference to FIG. 9.

Here, each the central processing unit 51 and the time management unit 52 properly acquires the information from a user input unit 55 when its processing is executed.

A display data creation unit 53 creates the graphic data on the basis of the control of the central processing unit 51, i.e., according to the command from the central processing unit 51, and controls the graphic image (e.g., the 3DCG image) corresponding to the graphic data in a display unit 54. As a result, the display unit 54 displays the graphic image corresponding to the graphic data created by the display data creation unit 53. Here, the detailed constitution example and the processing example of the display data creation unit 53 will be described hereinafter with reference to FIG. 7 and FIG. 11, respectively. Moreover, the specific example of the graphic image disposed in the display unit 54 by the control of the display data creation unit 53 will be described with reference to FIG. 12.

The display unit 54, the user input unit 55 and a power supply unit 56 are constituted of the LCD 12, the tact switch 11 and the power source unit 17, respectively, in case the wrist watch 1 has the hardware constitution of FIG. 2. Therefore, the functions owned by the display unit 54, the user input unit 55 and the power supply unit 56 are similar to the aforementioned respective functions owned by the LCD 12, the tact switch 11 and the power source unit 17, so that their descriptions are omitted. On the other hand, the example of the processing to be realized by the function owned by the power supply unit 56 will be described with reference to FIG. 8.

Figure 6:
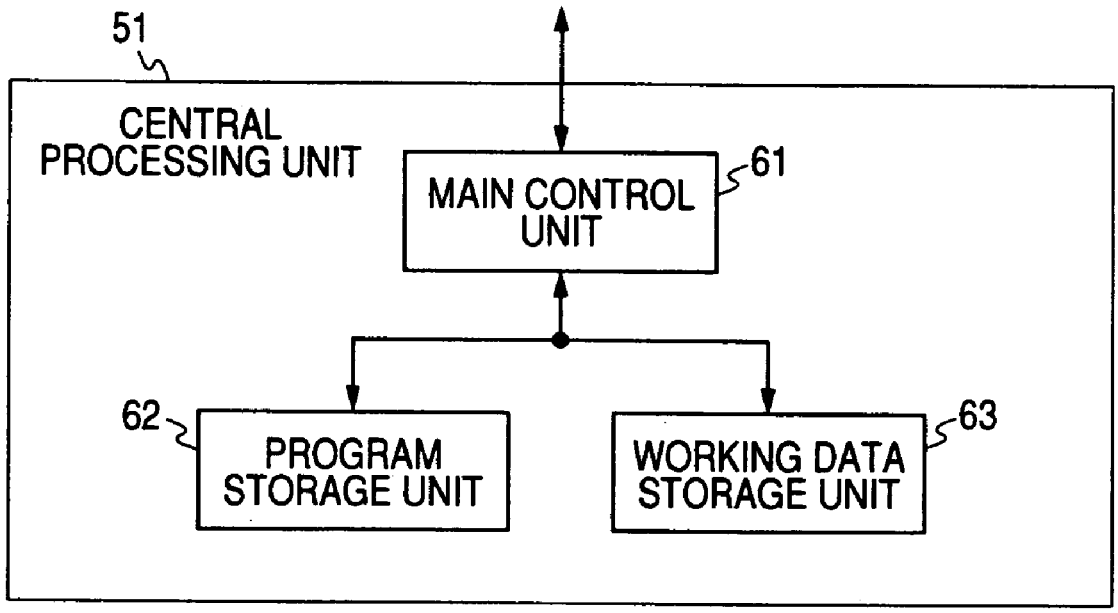
FIG. 6 is a functional block diagram showing an example of the detailed functional constitution of a central processing unit of the wrist watch of FIG. 5.

FIG. 6 shows a detailed example of the functional constitution of the central processing unit 51. In the example of FIG. 6, the central processing unit 51 is constituted to include a main control unit 61, a program storage unit 62 and a working data storage unit 63.

The main control unit 61, the program storage unit 62 and the working data storage unit 63 are constituted of the CPU 21, the Flash Memory 16 and the SD-RAM 15, respectively, in case the wrist watch 1 has the hardware constitution of FIG. 2.

Therefore, the main control unit 61 can select one or more of the various programs, as stored in the program storage unit 62, and can load it for executions into the working data storage unit 63. This working data storage unit 63 is stored with various kinds of data necessary for executing a predetermined program. Moreover, the working data storage unit 63 is stored with a starting program for loading the various programs stored in the program storage unit 62, for the starting operations into the working data storage unit 63. The starting program is made to act on the main control unit 61.

Here, the program, as stored in the program storage unit 62, and the processing to be realized by the program will be described with reference to FIG. 12 to FIG. 17.

Figure 7:
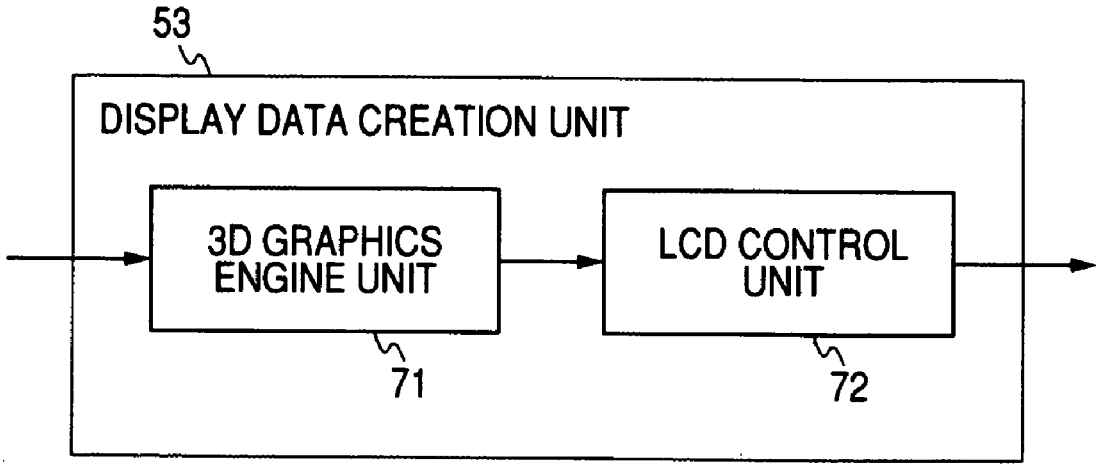
FIG. 7 is a functional block diagram showing an example of the detailed functional constitution of a display data creation unit of the wrist watch of FIG. 5.

FIG. 7 shows a detailed constitution example of the display data creation unit 53. In the example of FIG. 7, the display data creation unit 53 is constituted to include a 3D graphics engine unit 71 and an LCD control unit 72.

The 3D graphics engine unit 71 and the LCD control unit 72 are constituted of the 3DCG engine 22 and the LCD controller 23, respectively, in case the wrist watch 1 has the hardware constitution of FIG. 2. Therefore, the functions owned by the 3D graphics engine unit 71 and the LCD control unit 72 are similar to the aforementioned functions owned by the 3DCG engine 22 and the LCD controller 23, respectively, so that their descriptions are omitted.

The functional constitution examples of the wrist watch 1 have been described hereinbefore with reference to FIG. 5 to FIG. 7.

Here, the individual functional blocks, as shown in FIG. 5 to FIG. 7, are made to have the aforementioned constitutions, by premising that the wrist watch 1 has the hardware constitution of FIG. 2 in this embodiment. However, the individual functional blocks, as shown in FIG. 5 to FIG. 7, may be constituted, according to their hardware constitutions, of a single hardware, a single software or a combination of the hardware and the software.

Next, several examples of the actions of the wrist watch 1 having the functional constitutions of FIG. 5 to FIG. 7, that is, examples of the processing of the individual functional blocks constituting the wrist watch 1 are described with reference to FIG. 8 to FIG. 11.

Figure 8:
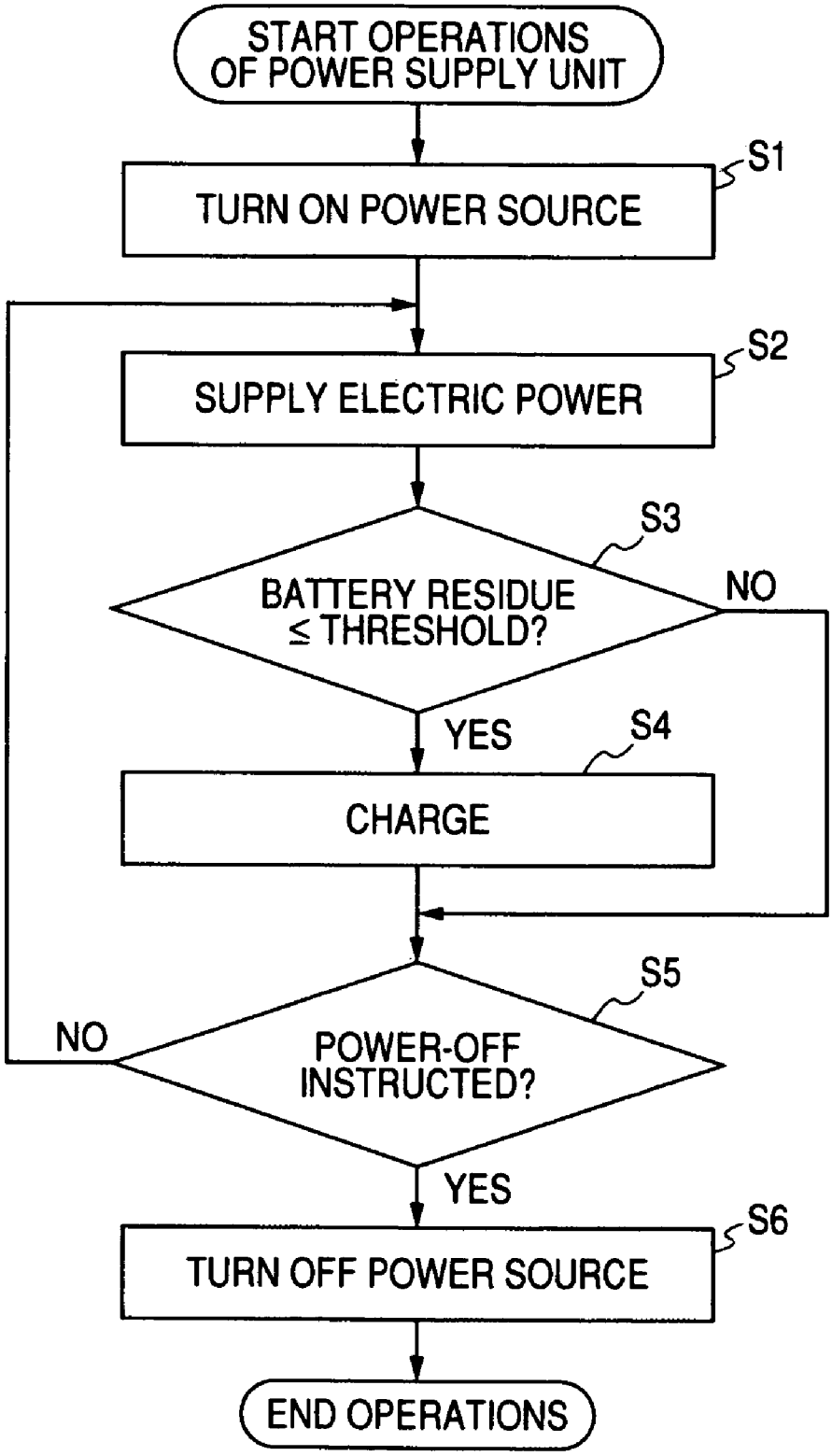
FIG. 8 is a flow chart for explaining a processing example of a power supply unit of the wrist watch of FIG. 5.

FIG. 8 is a flow chart for explaining a processing example of the power supply unit 56.

When the power ON is instructed, the power supply unit 56 turns ON the power source at Step 1. At Step S2, moreover, the power supply unit 56 supplies the central processing unit 51 through the display unit 54 individually with the electric power.

At Step S3, the power supply unit 56 decides whether or not the battery residue is at or less than the threshold value.

In case it is decided at Step S3 that the battery residue is at or less than the threshold value, the power supply unit 56 charges that battery at Step S4. When the charge is completed, the operation of Step S4 is ended, and the flow chart advances to Step S5.

In case, on the contrary, it is decided at Step S3 that the battery residue exceeds the threshold value (or not at or less than the threshold value), the operation (or charge) of Step S4 is not executed, but the flow chart advances to Step S5.

At Step S5, the power supply unit 56 decides whether or not the power OFF has been instructed.

In case it is decided at Step S5 that the power-OFF has been instructed, the power supply unit 56 turns OFF the power source at Step S6. As a result, the individual power supplies to the central processing unit 51 through the display unit 54 are interrupted to end the operation on the power supply unit 56.

In case, on the contrary, it is decided at Step S5 that the power-OFF has not been instructed, the flow chart is returned to Step S2, and the subsequent operations are repeatedly executed. Specifically, when the instruction of the power-OFF is not instructed and while the battery residue is exceeding the threshold value, the individual power supplies to the central processing unit 51 through the display unit 54 are continued.

Figure 9:
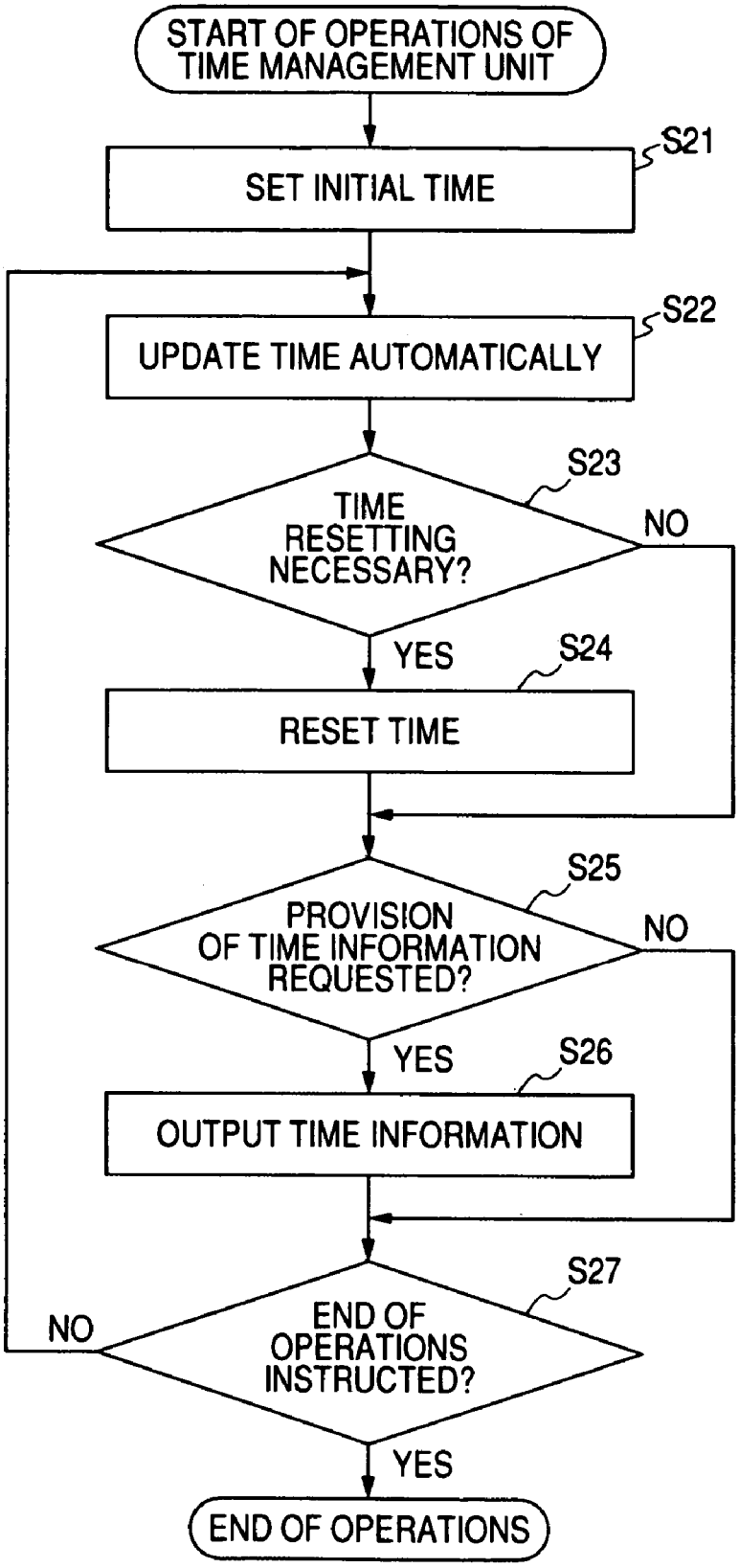
FIG. 9 is a flow chart for explaining a processing example of a time management unit of the wrist watch of FIG. 5.
Figure 10:
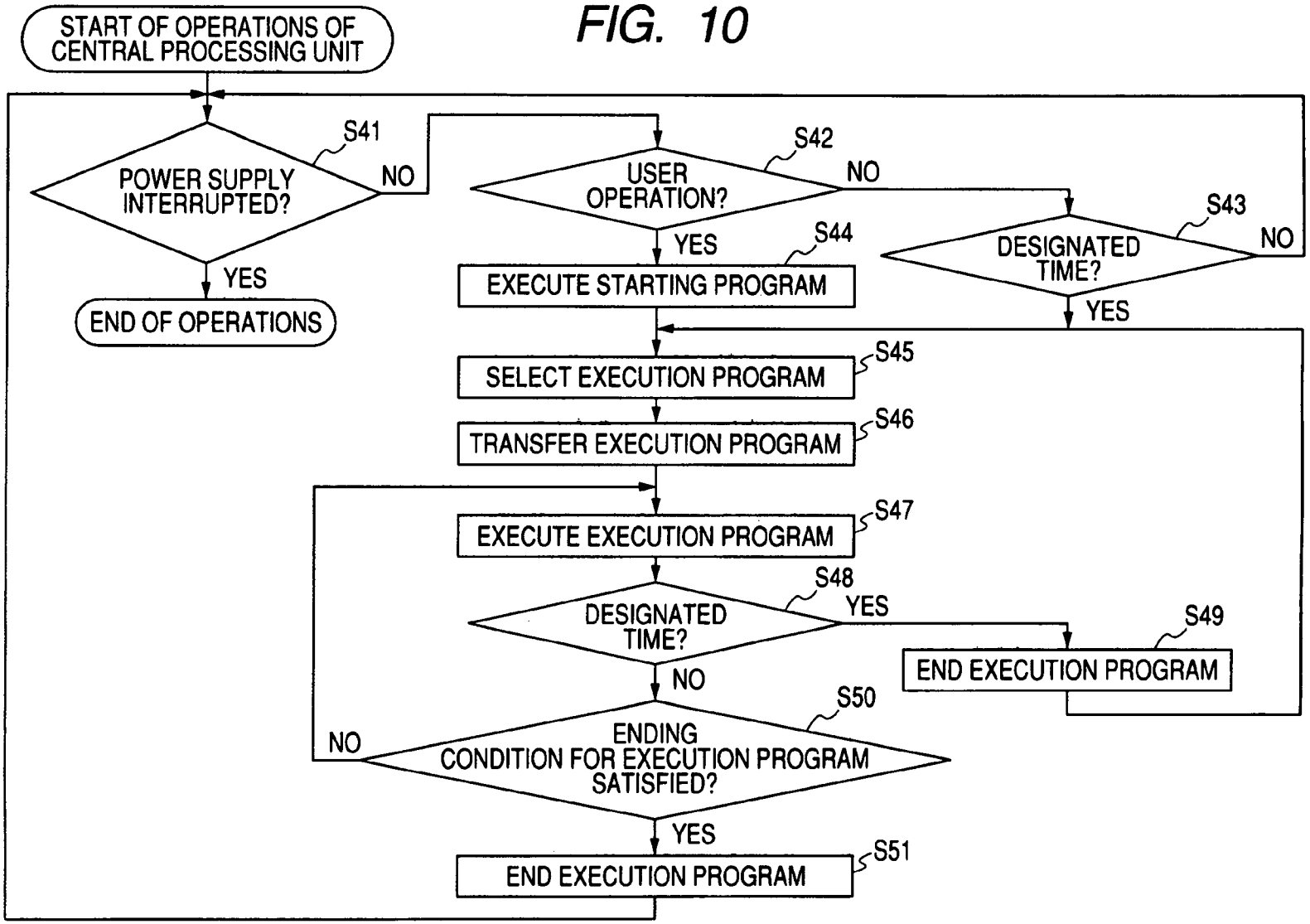
FIG. 10 is a flow chart for explaining a processing example of the central processing unit of the wrist watch of FIG. 5.

As has been described hereinbefore, when the power of the power supply unit 56 is ON (at Step S1), the power supply unit 56 feeds (at Step S2) the power to the central processing unit 51 through the display unit 54. As a result, the time management unit 52 and the central processing unit 51 can accept the input from the user input unit 55. With reference to FIG. 9 and FIG. 10, therefore, the operations of the time management unit 52 and the central processing unit 51 will be individually described in the recited order.

FIG. 9 is a flow chart for explaining a processing example of the time management unit 52.

At Step S21, the time management unit 52 sets the initial time.

Here, the operation of this Step S21, i.e., the initial time setting operation may be performed either at the shipping time of the wrist watch 1 and at the manufacturing place, or by the depression operation of the tact switch 11 in the example of FIG. 1.

At Step S22, the time management unit 52 performs an operation to update the time automatically (i.e., to tick the time by its own decision).

At Step S23, the time management unit 52 decides whether or not the time has to be reset.

In case it is decided at Step S23 that the time resetting is necessary, the time management unit 52 resets the time at Step S24. Here in this embodiment, it is assumed that the operation of Step S24, i.e., the time resetting operation is performed by the operation of the user input unit 55 by the user, i.e., by the depressing operation of the tact switch 11 in the example of FIG. 1. When the time resetting operation is completed, the flow chart advances to Step S25.

In case it is decided at Step S23 that the time resetting is unnecessary (i.e., not necessary), on the contrary, the flow chart advances to Step S25 without executing the operation of Step S24, i.e., the resetting operation of the time.

At Step S25, the time management unit 52 decides whether or not provision of the time information has been requested from the central processing unit 51.

Here, the concept that "the provision of the time information has been requested from the central processing unit 51" is so wide as to contain not only the concept "the provision of the time information has been explicitly requested at that time from the central processing unit 51" but also the concept that "the unexplicit provision of the time information has been requested by the central processing unit 51".

It means the following concept that "the unexplicit provision of the time information has been requested by the central processing unit 51". In the processing procedure (as referred to FIG. 10) of the central processing unit 51, for example, the selected execution program makes the control "to display the time at that instant". In this case, the period from the execution to the end of the execution program can be grasped as "the unexplicit provision of the time information has been requested by the central processing unit-51". For this time period, each time the central processing unit 51 is provided with the time information from the time management unit 52, the central processing unit 51 updates the time display. At this time, the central processing unit 51 does not have the information on what timing the time information providing request is issued at, the central processing unit 51 actively receives the time information provided at a predetermined interval from the time management unit 52, and performs the control of the time display. In this case, therefore, before a constant time interval elapses, it is decided that the provision of the time information is not requested at Step S25, and the flow chart advances to Step S27. When a constant time interval elapses, it is decided that the provision of the time information has been requested in the operation of Step S25, and the flow chart advances to Step S26.

Thus, the central processing unit 51 may perform the operation on the basis of the time information provided always at a predetermined interval from the time management unit 52. The central processing unit 51 may have to know the time at the predetermined instant in its operation routine and requests the provision of the time information (or executes the operation of Step S83 of FIG. 17, as will be described hereinafter). In either case, here it is defined that "the provision of the time information has been requested by the central processing unit 51".

Under the premises described above, in case it is decided at Step S25 that the provision of the time information has been requested by the central processing unit 51, the time management unit 52 outputs the time information to the central processing unit 51 at Step S26. As a result, the flow chart advances to Step S27.

In case, on the contrary, it is decided at Step S25 that the provision of the time information has not been requested, the flow chart advances to Step S27 while the operation of Step S26 being not executed.

At Step S27, the time management unit 52 decides whether or not the end of operations has been instructed.

In case it is decided at Step S27 that the end of operations is not instructed yet, the flow chart is returned to Step S22, at which the subsequent operations are repeatedly executed. Specifically, the time management unit 52 executes the time resetting operation and the operation to output the time information to the central processing unit 51, if necessary, while continuing the automatic updating operation of the time.

In case it is then decided at Step S27 that the end of operations has been instructed, the operations of the time management unit 52 are ended.

Next, a processing example of the central processing unit 51 is described with reference to the flow chart of FIG. 10.

A Step S41, the central processing unit 51 decides whether or not the power supply from the power supply unit 56 has been interrupted.

In case it is decided at Step S41 that the power supply has been interrupted, the operations of the central processing unit 51 are ended.

So long as the power supply from the power supply unit 56 continues, on the contrary, it is always decided at Step S41 that the power supply is not interrupted, and the flow chart advances to Step S42.

At Step S42, it is decided by the central processing unit 51 whether or not a user operation is made by the user input unit 55.

In case it is decided at Step S42 that the user operation was not, the central processing unit 51 decides it at Step S43 whether or not the time is the designated one.

Specifically in this embodiment, at the operation starting time of Step S43, the central processing unit 51 issues the time information provision request to the time management unit 52. In response to the time information provision request (when the answer of Step S25 of FIG. 9 is YES), as described above, the time management unit 52 outputs the time information to the central processing unit 51 (at Step S26). Then, the central processing unit 51 stores that time information in the working data storage unit 63 (FIG. 6), and decides whether or not the time specified by the time information is the designated time.

In case it is decided at Step S43 that the time is designated, the flow chart advances to Step S45. However, the operations at and after Step S45 will be described hereinafter.

In case, on the contrary, it is decided at Step S43 that the time is not designated one, the flow chart is returned to Step S41, and the subsequent operations are repeatedly executed. So long the power supply from the power supply unit 56 is continued, the central processing unit 51 keeps the standby state by repeatedly executing the loop operations of the answers NO of Step S41, NO of Step S42 and NO of Step S43, till the user operation is made or till the designated time is reached.

When the user operation is then made at the user input unit 55, it is decided that the answer of next Step S42 is YES, and the flow chart advances to Step S44.

At Step S44, the main control unit 61 (FIG. 6) of the central processing unit 51 executes the aforementioned starting program. This starting program executes the operations of at and after the next Step S45.

Specifically, the main control unit 61 selects at Step S45 the program (as will be called the "execution program") to be executed, from the various kinds of programs stored in the program storage unit 62, and transfers at Step S46 the execution program from the program storage unit 62 to the working data storage unit 63.

Specifically, it is assumed that the program storage unit 62 is stored with one or more control program produced by the application producer, i.e., the control program for executing the creation of the graphic data for indicating the time. Moreover, this control program should contain the data of the various kinds of models necessary for the 3D graphics engine unit 71 (FIG. 7) to create the graphic data (or the graphic image), the display method (or effect or modification pattern) of the various kinds of models, and the control commands of the display timings of the various kinds of models.

In this case, the main control unit 61 selects, at Step S45 generally according to the operation information sent from the user input unit 55, a predetermined control program as the execution program from the aforementioned one or more control programs. At Step S46, moreover, the main control unit 61 transfers that execution program from the program storage unit 62 to the working data storage unit 63.

Specifically, the user is enabled by operating the user input unit 55 to designate what control program is used to display the time. In this case, the information indicating the operation contents of the user input unit 55, that is, the information indicating the designated contents of the user is set as the operation information to the central processing unit 51. Then, the starting program (or the main control unit 61) selects, at Step S45, the execution program in accordance with the operation information obtained from the user input unit 55, and transfers, at Step S46, the execution program to the working data storage unit 63.

In case the operation information is not fed from the user input unit 55, the main control unit 61 has to execute the operation of Step S45, i.e., the predetermined one as the execution program from the time displaying control program, by using another method.

As another method, for example, there can be adopted a method, in which it is set as an initial value or a default value what control program is used (or selected) as the execution program at the shipping time and in the manufacturing place of the wrist watch 1, and in which the control program specified by that initial value or the default value is selected as the execution program.

As another method, there can also be adopted a method, in which the control program selected at random or in a predetermined order is used as the execution program.

As still another method, there can also be adopted a method, in which the control program designated by the user is repeatedly used (or employed) as the execution program.

Thus, the execution program is selected by the operation of Step S45, and is transferred to the working data storage unit 63 by the operation of Step S46. Then, the flow chart advances to Step S47.

At Step S47, the main control unit 61 executes the execution program.

For example, a predetermined one of the time displaying control programs is selected as the execution program, as has been described hereinbefore. As a result, the following series operations are executed as the operation of Step S47.

Specifically, the main control unit 61 issues the time information provision request to the time management unit 52. In response to this time information provision request (i.e., YES at Step S25 of FIG. 9), as described hereinbefore, the time management unit 52 outputs the time information to the central processing unit 51 (at Step S26). Then, the central processing unit 51 stores that time information in the working data storage unit 63.

If it is decided that the answer of Step S43 is YES, the operations may be omitted at Step S47 just after the execution of the operations of Steps S45 and S46.

Next, on the basis of the execution program and the time information stored in the working data storage unit 63, the main control unit 61 issues the creation command (as will be called the "image creation command") of the graphic data to the 3D graphics engine unit 71 (FIG. 7) of the display data creation unit 53.

Figure 11:
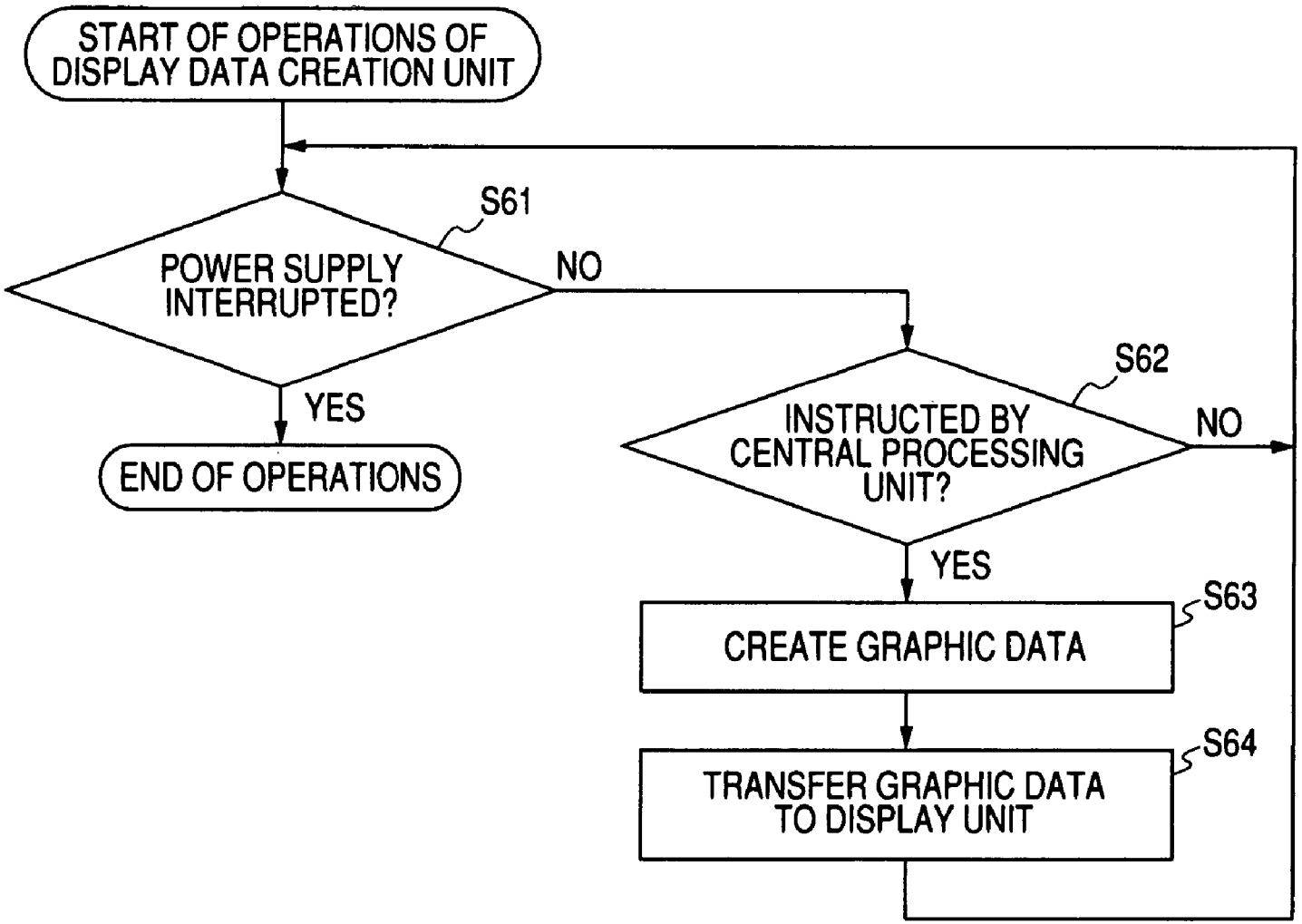
FIG. 11 is a flow chart for explaining a processing example of the display data creation unit of the wrist watch of FIG. 5.

On the basis of that image creation command, the 3D graphics engine unit 71 then creates the graphic data (or graphic image) any time (as referred to YES at Steps S62 and S63 of FIG. 11).

The graphic data, as created by the 3D graphics engine unit 71, is transferred through the LCD control unit 72 (FIG. 7) to the display unit 54 (FIG. 5) (as referred to Step S64 of FIG. 11). As a result, the graphic image corresponding to the graphic data, such as the time indicating 3DCG image, as shown in FIG. 3 or in FIG. 12, is displayed in the display unit 54.

Here at the time changing timing, the 3DCG image (or the moving image), in which the numeral indicating the time is gradually deformed, can be easily displayed in the display unit 54 by using the morphing, as described in FIG. 4.

On the other hand, one specific example of the time displaying control program will be described with reference to FIG. 12 to FIG. 17.

When the program is executed by the operation of Step S47 so that the time displaying graphic image is displayed on the display unit 54, the flow chart advances to Step S48.

At Step S48, the main control unit 61 decides whether or not the time is one designated in the execution program.

Specifically in this embodiment, at the time of starting the operation of Step S48, the central processing unit 51 issues the time information provision request to the time management unit 52. As described above, the time management unit 52 outputs (at Step S26) the time information to the central processing unit 51 in response to the time information provision request (i.e., YES at Step S25 of FIG. 9). Therefore, the central processing unit 51 stores that time information in the working data storage unit 63, and decides whether or not the time specified by that time information is the designated time.

Here, it is assumed, for example, that the execution program contains a command to change the time indicating control program when the designated time comes.

When the time designated by the execution program comes, the answer of Step S48 is YES, and the flow chart advances to Step S49. At Step S49, the main control unit 61 ends the execution program. After this, the flow chart is returned to Step S45, so that the subsequent operations are repeatedly executed. In other words, another control program is selected as the execution program, so that the operation for the time display is executed according to that another control program.

In case the time is not one designated by the execution program (or in case there is not any time that is designated by the execution program), on the contrary, the answer of Step S48 is NO, and the flow chart advances to Step S50.

At Step S50, the main control unit 61 judges whether or not the ending condition for the execution program (excepting the condition for becoming the designated time) is satisfied.

In case the ending condition for the execution program is not satisfied, the answer of Step S50 is NO, and the flow chart is returned to Step S47 so that the subsequent operations are repeatedly executed. Specifically, till the ending condition (including the condition for the designated time) of the execution program is satisfied, there is continued the execution of the control program which is selected as the execution program at that instant.

When the ending condition for the execution program (excepting the condition for becoming the designated time) is satisfied, it is decided that the answer of Step S50 is YES, and the flow chart advances to Step S51. At Step S51, the main control unit 61 ends the execution program. After this, the flow chart is returned to Step S41, so that the subsequent operations are repeatedly executed.

Thus, there has been described the case, in which the time displaying control program is selected as the execution program. In this case of example, the display data creation unit 53 of FIG. 7 executes the operations necessary for the time display, as has been described hereinbefore. An example of the operation of the display data creation unit 53 is shown in FIG. 11. Therefore, an example of the operation of the display data creation unit 53 is described with reference to the flow chart of FIG. 11.

At Step S61, the display data creation unit 53 decides whether or not the power supply from the power supply unit 56 has been shielded.

In case it is decided at Step S61 that the power supply is interrupted, the operation of the display data creation unit 53 is ended.

So long as the power supply from the power supply unit 56 is continued, on the contrary, it is always decided at Step S61 that the power supply is not interrupted, and the flow chart advances to Step S62.

At Step S62, the display data creation unit 53 decides whether or not an instruction (to create the image) has been made by the central processing unit 51.

In case it is decided at Step S62 that the instruction (or the image creating command) is not made from the central processing unit 51, the flow chart is returned to Step S61, so that the subsequent operations are repeatedly executed. So long as the power supply from the power supply unit 56 is continued, the display data creation unit 53 executes the loop operations of NO of Step S61 and NO of Step S62 are repeated executed to keep the standby state, till the instruction (or the image creating command) from the central processing unit 51 is made.

After this, the central processing unit 51 issues the image creating command (or instruction) to the 3D graphic engine unit 71 (FIG. 7) of the display data creation unit 53 (e.g., one example of the operation of Step S47 of FIG. 10, such as the operation of Step S87 of FIG. 17, as will be described hereinafter). Then, the answer of the next Step S62 is YES, and the flow chart advances to Step S63.

At Step S63, the 3D graphic engine unit 71 creates the graphic data (or graphic image) any time on the basis of that image creating command.

Here, the display data creation unit 53 makes access at any time to the working data storage unit 63 of the central processing unit 51 when in the operation of the Step S63, and creates the graphic data while storing the temporary data (e.g., the data of the model) necessary for creating the graphic data and the operation result for a while.

At Step S64, the 3D graphics engine unit 71 transfers the graphic data crated by the operation of Step S63, to the display unit 54 (FIG. 5) through the LCD control unit 72.

As a result, the graphic image corresponding to that graphic data, such as the time displaying 3DCG image, as shown in FIG. 3 or FIG. 12, is displayed in the display unit 54.

By using the morphing, as described with reference to FIG. 4, at the time changing timing, the 3DCG image (or the moving image), in which the numeral of the time is gradually deformed, can be easily displayed in the display unit 54. Specifically, the wrist watch 1 having the functional constitution of FIG. 5 is prepared with one or more control programs for controlling the transition between the image used for the time display or the like and the individual images. By creating the actual graphic image (or graphic data) in real time, the morphing can be realized under the load of a small data quantity and a processing, thereby to make a time display of a higher expressive power.

After this, the flow chart is returned to Step S61, so that the subsequent operations are repeatedly executed.

With reference to FIG. 12 to FIG. 17, here will be described one specific example of the time displaying control program (i.e., the execution program, as called so in the operation of the central processing unit of FIG. 10).

By executing the control program of this example, the expression of time by the image momentarily changing with the flow of time, that is, the expression of time, in which the environment (i.e., the environment expressed by the image) in the screen of the display unit 54 momentarily changes, can be made without resorting to the expression of time such as the hands or numerals in the watch of the relevant art. Therefore, the watch to be realized by this expression of time will be called the "environment watch", and the control program of this example for realizing the environment watch will be especially called the "execution program for the environment watch".

Here, the environment in the screen of the display unit 54 is the various kinds of situations in a predetermined virtual space displayed in the display unit 54, such as the various kinds of situations (e.g., the shape, pattern or coloration at that instant, or their combination, or the existing position in the virtual space) of the individual constitution elements of the image indicating the virtual space. Therefore, the change in the environment in the screen of the display unit 54 is the change in the state of at least one of plural objects existing in the virtual space, that is, the change in the shape, pattern or coloration of a predetermined object, their combination, or a change in their positions.

By executing the environment watch execution program, for example, it is assumed that the 3DCG image (as will be simply called the "virtual space of FIG. 12") expressing the virtual space, as shown in FIG. 12, is displayed in the display unit 54.

The objects existing in the virtual space of FIG. 12 are: a housing 81 such as a house (as will be shortly called the "house 81"); a sky 82; the sun 83; an animal 84 such as a cow (as will be shortly called the "cow 84"); a plant 85 such as a tree (as will be shortly called the "tree 85"); a shadow 86; an automobile 87 such as a car (as will be shortly called the "car 87"); a celestial body 88 such as the moon (as will be shortly called the "moon 88"); a background 89 such as a mountain (as will be shortly called the "mountain 89"); and a clock tower 90. Here in the example of FIG. 12, only the shadow 86 of the tree 85 is shown. As a matter of fact, however, each of the shadows of the house 81, the cow 84, the car 87, the clock tower 90 and so on can be contained as one object.

The individual times can be expressed by the following environmental changes of the individual objects in the virtual space of FIG. 12.

Specifically for the house 81, the time can be expressed by the ON/OFF of internal lights, the visitors or the motions of internal silhouettes (or silhouettes of residents).

For the sky 82, the time can be expressed by the change (not only whole but also partial) in the brightness or color, or in the presence (or movement) or absence of a cloud.

For the sun 83, the time can be expressed by the change in the position, orbit, color and size of the sun.

For the cow 84, the time can be expressed by the change in the motion, the position, or the locus of movement of the cow.

For the tree 85, the time can be expressed by the external change in the growing procedure or the change in the leaf color.

For the shadow 86, the time can be expressed by the change in its length or angle.

For the car 87, the time can be expressed by the various movements of a predetermined moving pattern (which may change by itself), the change in the appearance, the departure from a predetermined place (e.g., the house 81) or the homecoming timing.

For the moon 88, the time can be expressed by the position, the waxing and waning of the moon, or the change in the orbit.

For the mountain 89, the time can be expressed by the change in the color due to the vegetation, or the external change of the season ornament.

For the clock tower 90, the time can be expressed by the change in the hands of the clock (or the change like that of the actual watch).

When the execution program for the environment watch of this embodiment is thus executed, the environment of the virtual space of FIG. 12 momentarily changes. By visually confirming the changing contents, therefore, the user can recognize the various kinds of time information such as the current time.

Figure 13:
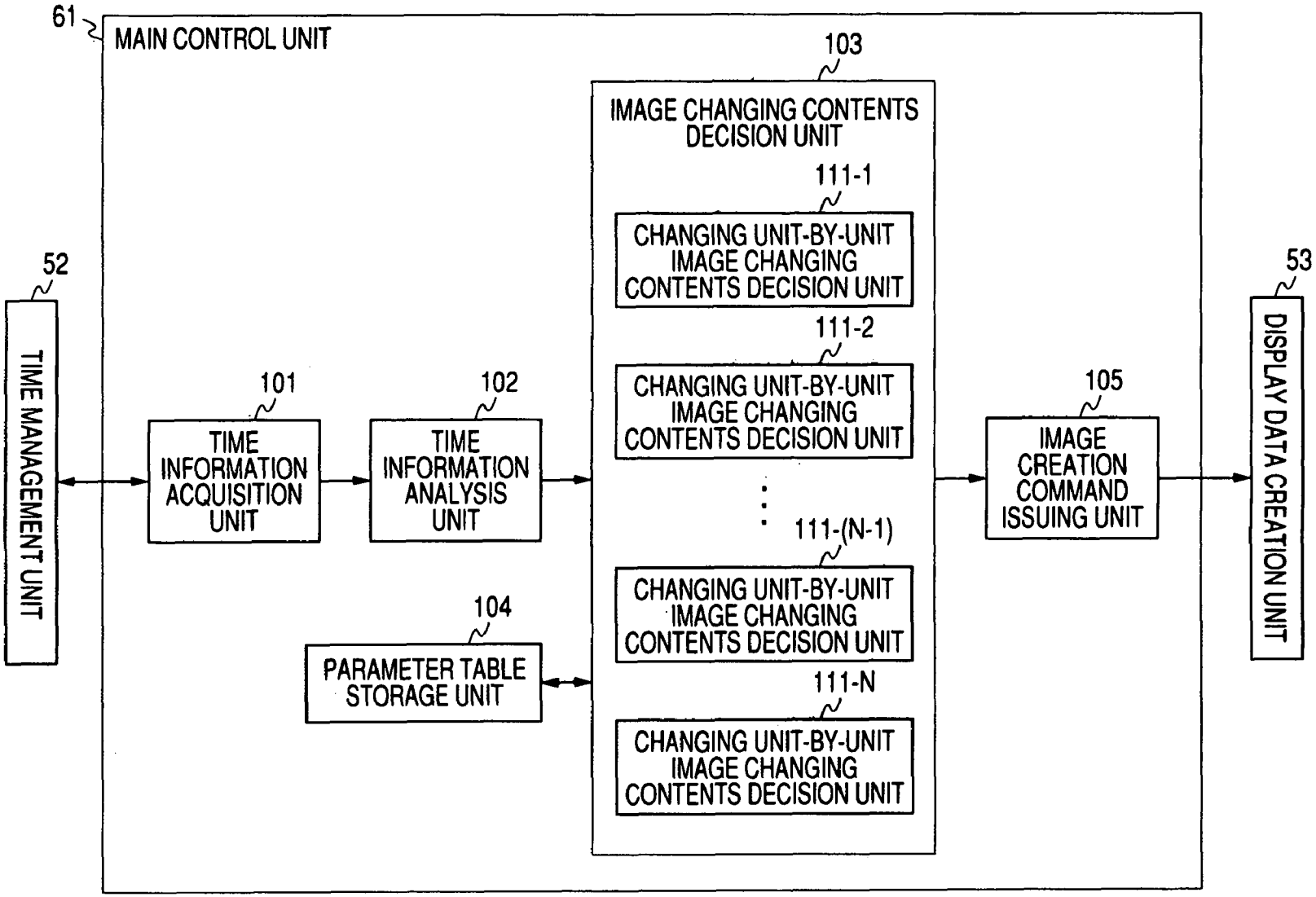
FIG. 13 is a functional block diagram showing an example of the functional constitution of a main control unit of the central processing unit of FIG. 10 of the case, in which the execution program for the environment watch according to an embodiment of the invention is executed.

When the execution program for the environment watch of this embodiment is executed, the main control unit 61 of the central processing unit 51 of FIG. 6 has the functional constitution shown in FIG. 13.

When the execution program for the environment watch is executed in this embodiment, the main control unit 61 is constituted to include the time information acquisition unit 101 to the image creation command issuing unit 105.

Alternatively, the execution program for the environment watch is constituted to include a plurality of modules such as the time information acquisition unit 101 to the image creation command issuing unit 105. The main control unit 61 may execute those plural modules properly, if necessary, and may output the execution results, if necessary, to the outside or another module (e.g., the module indicated by the tip of the arrow in the example of FIG. 13).

The time information acquisition unit 101 issues the time information provision request at a predetermined timing (e.g., the timing of Step S83 of FIG. 17, as will be later described) to the time management unit 52. Then, the time management unit 52 outputs the time information (as referred to Step S26 of FIG. 9), as described hereinbefore, so that the time information acquisition unit 101 acquires the time information and provides the time information analysis unit 102 with the time information.

By analyzing that time information, the time information analysis unit 102 expresses again the absolute time (or the current time) indicated by that time information, with individual units, and provides the image changing contents decision unit 103 with the individual time instants which are expressed again by using the individual units.

Here, the expression of the time by using a predetermined unit is to express the information on the "month", i.e., the "october" of the time "10:47:53 of Oct. 11, 2005", if the absolute time (or the current time) indicated by the time information is "10:47:53 of Oct. 11, 2005" and if the predetermined unit is "month".

This predetermined unit adopted is exemplified in this embodiment by: not only the aforementioned "month" but also "year", "four seasons", "day", "half day", "morning, noon, evening or night", "one hour", "one minute", "one second" or the "absolute time".

Here, at each of these predetermined units, the changing contents of the environment in the virtual space of FIG. 12 are individually decided by the image changing contents decision unit 103, as will be described hereinafter. Thus, this predetermined unit will be called the "changing unit". According to this naming, moreover, the time, as expressed again by using the changing unit, will be totally called the "changing unit time".

In this case, when the absolute time (or the current time), as indicated by the time information, is "10:47:53 of Oct. 11, 2005", the time information analysis unit 102 provides the image changing contents decision unit 103 individually with: "2005" as the changing unit time of the "year" (as will be called the "year time"); the "autumn" as the changing time unit of the "four seasons" (as will be called the "four-season time"); the "october" as the changing time unit of the "month" (as will be called the "month time"); the "11" as the changing time unit of the "day" (as will be called the "day time"); the "am" as the changing time unit of the "half day" (as will be called the "half day time"); the "morning" as the changing time unit of the "morning, noon, evening and night" (as will be called the "morning, noon or the like"); the "10 o'clock" as the changing time unit of the "one hour" (as will be called the "hour time"); the "47 minutes" as the changing time unit of the "one minute" (as will be called the "minute time"); the "53 seconds" as the changing time unit of the "one second" (as will be called the "second time"); and the "10 o'clock, Oct. 11, 2005" as the changing time unit of the "absolute time" (as will be called the "absolute time").

The image changing contents decision unit 103 decides the changing contents of the environment in the virtual space of FIG. 12, individually at the changing unit times provided by the time information analysis unit 102. As the blocks for deciding the changing contents for one predetermined changing unit, therefore, changing unit-by-unit image changing contents decision units 111-1 to 111-N (wherein N indicates the number of changing units adopted, and N=10) are disposed in the image changing contents decision unit 103.

Specifically, each of the changing unit-by-unit image changing contents decision units 111-1 to 111-10 decides such one of the changing contents of the environment in the virtual space of FIG. 12 as responses to the change unit time expressed by the corresponding changing unit.

For example, it is considered to decide the changing contents of the mountain 89 in the virtual space of FIG. 12. However, it is assumed that only the "four-season" and the "one hour" are adopted as the changing unit for simplicity of explanation only while the decision of the changing contents of the mountain 89 is being explained. Specifically, it is assumed that only the changing unit-by-unit image changing contents decision unit 111-1 for deciding the changing contents of the "four-season" and the changing unit-by-unit image changing contents decision unit 111-2 for deciding the changing contents of the "one hour" are contained in the image changing contents deciding unit 103.

Noting the change of the "four-season" in this case, the actual mountain has its color changed with the trees or snow covering it. According to this actual change, therefore, the base color is adopted as the changing contents of the "four-season" of the mountain 89. If the color of the "spring", the color of the "summer", the color of the "autumn" and the color of the "winter" are individually defined in advance, the changing unit-by-unit image changing contents decision unit 111-1 can decide the color corresponding to the four-season time provided by the time information analysis unit 102, as the base color of the mountain 89 and as the changing contents (or the base color) of the "four-season" of the mountain 89. In the aforementioned example, for example, the "autumn" is provided as the four-season time, so that the changing unit-by-unit image changing contents decision unit 111-1 decides the color of the "autumn" as the base color of the mountain 89.

In this embodiment, more specifically, it is assumed that parameter values (or discriminators) such as "100", "200", "300" and "400" are given in advance to the color of the "spring", the color of the "summer", the color of the "autumn" and the color of the "winter", which can be the base colors of the mountain 89, and that the table of FIG. 14 expressing their relations is stored in the parameter table storage unit 104 (FIG. 13).

In this case, the changing unit-by-unit image changing contents decision unit 111-1 decides the parameter values corresponding to the four season times provided from the time information analysis unit 102, with reference to the table of FIG. 14, as stored in the parameter table storage unit 104. In the aforementioned example, for example, the "autumn" is provided as the four-season time, and the parameter value "300" is decided so that the image creation command issuing unit 105 is provided with the decided parameter value (i.e., "300" in the aforementioned example).

Noting the change of the "one hour", on the other hand, the chroma of the actual mountain changes with the change in the position of the sun or the moon (including the case, in which the sun or the moon sinks). In accordance with this actual change, therefore, the chroma is adopted as the changing contents of the "one hour" of the mountain 89. If, therefore, the individual chromas of the "01 o'clock" to "24 o'clock" constituting one day (24 hours) are defined in advance, the changing unit-by-unit image changing contents decision unit 111-2 can decide the chroma corresponding to the time hour provided by the time information analysis unit 102, as the chroma of the mountain 89 or the changing contents (or the chroma) of the "one hour" of the mountain 89. In the aforementioned example, for example, the "10 o'clock" is provided as the time hour, so that the changing unit-by-unit image changing contents decision unit 111-2 decides the chroma of "10 o'clock" as the chroma of the mountain 89.

In this embodiment, more specifically, it is assumed that the parameter values (as may be gasped as identifiers) such as "01" to "24" are given in advance to the individual chromas of the "01 o'clock" to "24 o'clock", which can become the chromas of the mountain 89, and that the table of FIG. 15 showing those relations are stored in the parameter table storage unit 104 (FIG. 13).

In this case, the changing unit-by-unit image changing contents decision unit 111-2 decides the parameters corresponding to the time hour provided by the time information analysis unit 102, with reference to the table stored in the parameter table storage unit 104. In the aforementioned example, for example, the "10 o'clock" is provided as the time hour so that the "10" is decided, and the image creation command issuing unit 105 is provided with the decided parameter value (i.e., "10" in the aforementioned example).

In this case, the image creation command issuing unit 105 of FIG. 13 creates the image creating command to draw the mountain 89 in the base color provided from the changing unit-by-unit image changing contents decision unit 111-1 and in the chroma provided from the changing unit-by-unit image changing contents decision unit 111-2, and provides that image creating command to the display data creation unit 53.

For example, specifically, the base color provided from the changing unit-by-unit image changing contents decision unit 111-1 and the chroma provided from the changing unit-by-unit image changing contents decision unit 111-2 are individually provided as the parameter values. Therefore, the image creation command issuing unit 105 of FIG. 13 performs the predetermined calculating operations utilizing those parameters, and provides the display data creation unit 53 with the calculated result as the image creating command concerning the mountain 89.

In this embodiment, it is assumed that the predetermined calculating operation method adopts a method of summing up the individual parameter values, although not especially limitative. According to this method, in the aforementioned example, the total value "310" of the "300" provided by the changing unit-by-unit image changing contents decision unit 111-1 and the "10" provided by the changing unit-by-unit image changing contents decision unit 111-2 is created as the image forming command on the mountain 89, and is provided to the display data creation unit 53.

Of the individual parameter values (101 to 424) enumerated in the table of FIG. 16, one corresponding parameter value is decided, by the image creation command issuing unit 105, as the image creation command on the mountain 89, and is provided to the display data creation unit 53.

Here, the table of FIG. 16 may be stored in place of the aforementioned tables of FIG. 14 and FIG. 15 in the parameter table storage unit 104, so that the image changing contents decision unit 103 may provide the image creation command issuing unit 105 with such one (i.e., "310" in the aforementioned example) of the individual parameter values enumerated in the table of FIG. 16 as is specified by the four-season time and the time hour provided from the time information analysis unit 102, as the changing contents of the mountain 89.

The following cares are necessary for giving the parameter values of individual variable units, in case the aforementioned method of using the sum of the parameter values of the varying units as the image forming command is adopted as the method of creating the image forming commands on the mountain 89 by the image creation command issuing unit 105.

In the description thus far made, it is assumed that only two of the "four-season" and "one hour" were adopted as the changing units for simplicity of description. Even if the "1" to "24" are adopted as the parameter values of the "one hour" and even if "100" to "400" are adopted as the parameters of the "four seasons", the sum of the two parameter values never fails to become a unique value (i.e., a value different from those of other combinations) in any combination.

As a matter of fact, however, it is frequent that more changing units are adopted. In this embodiment, for example, total ten changing units including the "year" are adopted in fact. In this embodiment, therefore, the individual changing unit-by-unit image changing contents decision units 111-1 to 111-10 decide the parameter values of the corresponding changing units individually. In this case, if "1" to "24" are adopted as they are as the parameters of the "one hour" and if "100" to "400" are adopted as they are as the parameter values of the "four seasons", the sums may be identical depending upon the combination. In this case, even if the identical sum for a plurality of combinations is provided as the image forming command on the mountain 89 to the display data creation unit 53, this display data creation unit 53 cannot discriminate the difference in those combinations so that the image changing contents decision unit 103 cannot draw the mountain 89 according to the changing contents decided.

It is, therefore, necessary to impose the condition for the sum to become different from that of another combination (that is, to become unique), upon any combination of the parameter values of individual changing unit. It is also necessary to give parameters individually to the changing units so that the condition may be satisfied.

Examples of the technique employable for giving the parameters satisfying the condition include a technique in which the parameter values are sequentially given on the individual changing unit basis from the shortest changing unit ("second" in this embodiment) in the direction where the time width elongate, wherein the parameter value larger by at least one digit than the parameter value of the previous changing unit (the changing unit with a time width shorter by one unit) is given.

The description thus far made is limited to only the determination of changing contents of the mountain 89 of the individual objects of the virtual space of FIG. 12. Absolutely likewise the objects other than the house 81 and so on, the changing contents are individually decided for every changing units, and the contents (i.e., the sum of the parameter values of the individual changing units) synthesized from the changing contents of the decided changing units are the changing contents of the object entirety, i.e., the image creating command on that object.

At this time, the sum of the changing contents of all changing units need not be adopted as the changing contents of the whole of a predetermined object, but some predetermined changing contents may be selected so that their sum may be adopted.

The flow chart of FIG. 17 shows the series of operations thus far described, that is, the operations of the case, in which the execution program for the environment watch is executed, or the operations of the main control unit 61 having the functional constitution of the example of FIG. 13 (as will be called the "execution program operations for the environment watch").

Thus, one example of the execution program operations for the environment watch is newly described with reference to the flow chart of FIG. 17.

When the execution program for the environment watch is executed by the operation of FIG. 10 at Step S47, as described hereinbefore, the functional constitution of the main control unit 61 becomes the example of FIG. 13, and that execution program for the environment watch is started.

At Step S81, the main control unit 61 of FIG. 13 decides whether or not the time period of one processing unit has elapsed. Here, the time period of one processing unit is the so-called "one clock" in the hardware constituting the main control unit 61, that is, the CPU 21 of the system IC 13 of FIG. 2 in this embodiment. Therefore, the time period of one processing unit is difference according to the performance of the CPU 21.

In case it is decided at Step S81 that the time period of one processing unit has not elapsed yet, the flow chart is returned to Step S81, at which it is decided again whether or not the time period of one processing unit has elapsed. In other words, the operations of the execution program for the environment watch are in the standby state till the time period of one processing unit elapses.

When the time of one processing-unit then elapses, it is decided that the answer of Step S81 is YES, and the operations of S82 to S87 are executed.

At Step S82, the main control unit 61 decides whether or not the end of the execution program of the environment watch has been instructed.

In case the operation of Step S51 of FIG. 10 is executed in this embodiment, that is, in case the answer of Step S50 is YES, it is decided at Step S82 that the end of the execution program for the environment watch has been instructed, and this execution program for the environment watch is ended.

In other cases, that is, in case the answer of Step S50 is NO, according to this embodiment, it is decided at Step S82 that the end of the execution program for the environment watch is not instructed yet, and the flow chart advances to Step S83.

At Step S83, the time information acquisition unit 101 of the main control unit 61 issues the time information provision request to the time management unit 52. When the time information is outputted from the time management unit 52 (as referred to Step S26 of FIG. 9), the time information acquisition unit 101 acquires at Step S84 the time information and provides the time information analysis unit 102 with the time information acquired.

At Step S85, the time information analysis unit 102 analyzes the time information, and the changing unit time is decided at each changing unit and is provided to the image changing contents decision unit 103.

At Step S86, the image changing contents decision unit 103 refers to the various kinds of tables (e.g., the aforementioned tables of FIG. 14, FIG. 15 and so on) stored in the parameter table storage unit 104, decides the parameter values corresponding to the changing unit time, at each changing unit for the individual objects (e.g., the mountain 89) in the virtual space of FIG. 12, and provides the parameter values to the image creation command issuing unit 105.

At Step S87, on the basis of the parameter values of the individual changing units of each object, the image creation command issuing unit 105 creates the image creation command (or the changing contents of each object entirety) on each object, and issues image creation command to the display data creation unit 53.

After this, the flow chart is returned to Step S81, so that the subsequent operations are repeated. At each time of one processing unit, the loop operations from Step S82 to Step S87 are executed. As a result, for each time of one processing unit, the image creation command is issued to the display data creation unit 53 so that the environment in the virtual space of FIG. 12 to be displayed in the display unit 54 (of FIG. 5 or the like) is momentarily changed each time of one processing unit in accordance with the control of the display data creation unit 53.

Generally speaking, however, the time period of one processing unit is frequently shorter than the shortest changing unit (e.g., "one second"). In this case, therefore, the environment in the virtual space of FIG. 12 momentarily changes at each time of the shortest changing unit (although reflected, as if continuously changed, on the eyes of the user, if the aforementioned morphing is utilized).

In case the change of the environment is the movement of the object, more specifically, the object is so reflected on the eyes of the user as if not moved during one pixel movement, when the movement at the shortest changing rate is within one pixel of the display unit 54. In case the change of the environment is the movement of the object, the movement of one pixel unit of the display unit 54 of the object is the shortest change of the environment, as reflected on the eyes of the user.

What should be noted here is that the entire changing contents of the environment in the virtual space of FIG. 12 are synthesized from the changing contents (i.e., the changing contents expressed in the parameter values in this embodiment) for each changing unit on the individual objects. As a result, so long as the decision is made at the shortest changing unit (e.g., "one second" in this embodiment), the environment (i.e., the display contents of the display unit 54) in the virtual space of FIG. 12 at a predetermined instant is unique in the cycle of the longest changing unit (or perpetual in case the longest changing unit is the "year" as in this embodiment), that is, never fails to be different from the environment at another instant.

In this embodiment, as described above, the "absolute time" is adopted as the changing unit, and the changing unit-by-unit image changing contents decision units 111-10 decides such one of the changing contents in the virtual space of FIG. 12 as corresponds to the "absolute time". Here, the changing contents corresponding to the "absolute time" are the contents which are present to change only when they become a predetermined point (or a specific time) on the time axis. Specifically, the changing unit-by-unit image changing contents decision units 111-10 decides, when the predetermined point (or the specific time) on the time axis is provided as the "absolute time"), the environment in the virtual space of FIG. 12, to the set contents. As a result, the display unit 54 displays the virtual space of FIG. 12, in which the environment is changed according to the set contents.

Specifically, it is assumed that the changing contents to decorate the tree 85 when the first time of the so-called "Christmas Even (December 24) comes are preset, and that the changing contents to remove the decorations of the tree 85 when the second time of December 25 are present (or it is assumed that the parameters indicating such special changing contents are stored in the parameter table storage unit 104). When the first time of the Christmas Eve is then provided as the "absolute time", the changing unit-by-unit image changing contents decision units 111-10 decides to decorate the tree 85 (or to make such a display). As a result, the display unit 54 displays the decorated tree 85. When the second time of Christmas Eve is provided as the "absolute time", the changing unit-by-unit image changing contents decision units 111-10 makes a decision to remove the decoration of the tree 85 (or to make such a display). As a result, the tree 85 having the decoration removed is displayed in the display unit 54.

Here, the changing contents corresponding to that "absolute time" may be set either previously by the manufacturer before the shipment of the wrist watch 1 (FIG. 1) or later by the user. In the latter case, the user can set arbitrary changing contents (or desired event) desired by the user, at an arbitrary absolute time desired by the user, such as a memorial day of the user.

This function is convenient for the user, and the following various kinds of functions can also be installed as the functions convenient for the user, on the execution program for the environment watch.

For example, it is possible to install such a function on the execution program for the environment watch as to display the watch reflecting the absolute time (or the current time) indicated by the time information, precisely on the clock tower 90 of FIG. 12. By realizing this function, the user is enabled to know the precise absolute time and to compensate the precise time information, when the clock of the clock tower 90 of FIG. 12 is observed.

Specifically, the virtual space of FIG. 12, as displayed in the display unit 54 (FIG. 5), contains a plurality of objects (i.e., the individual constituting elements of an image, such as the mountain 89), which are triggered to uniquely change by the time information. Therefore, the user is also enabled to recognize the time intuitively by seeding those objects singly or synthetically, or to be conscious of the time of the new future by the future prediction of continuous image changes. On the other hand, the continuous changes can teach the user the timing or the like to start the preparations for the planned action to be done at the target time.

However, some user may desire to know the more precise absolute time (or the time of finer unit) than that which is grasped by the intuitive time recognition of this case. In case this desire of the user has to be satisfied, this function, namely, the function to display the watch precisely reflecting the absolute time (or the current time) indicated by the time information may be installed in the execution program for the environment watch.

Moreover, the function to zoom up the image of the clock of the clock tower 90 of FIG. 12 instantly can also be installed on the execution program for the environment watch. By realizing this function, the user is enabled to recognize the far more precise and finer time (or the absolute time) quickly and easily.

Still moreover, for example, the function to zoom up the image corresponding to an arbitrary place other than the clock of the clock tower 90 in the virtual space of FIG. 12 instantly can also be installed in the execution program for the environment watch. This function can excite, when realized, the curiosity of the user.

Still moreover, for example, the function to perform a new action on the object existing in the virtual space of FIG. 12 or to cause the new object not present in the virtual space of FIG. 12 to appear by the condition judgment or the like on the basis of the operation history or the like of the user till then can also be installed on the execution program for the environment watch.

Still moreover, for example, the function to change the setting so that the user may recognize the time more easily by himself according to the taste of the user or to set the changing contents, as caused by the time, of each object freely can be installed on the execution program for the environment watch. Still moreover, for example, the function for the user to customize the environment in the virtual space of FIG. 12 (or the display image of the display unit 54) according to the taste of the user can also be installed on the execution program for the environment watch. By realizing those functions, the timing of the time needed by the user can be expressed according to the taste of the user.

As the execution program for the environment watch, on the other hand, this embodiment has adopted the control program for displaying the virtual space (or the image) of FIG. 12 in the display unit 54 (FIG. 5), and is not especially limited to that control program but can adopt various control programs. Therefore, several other specific examples of the execution program for the environment watch will be schematically described in the following.

For example, it is possible to adopt the execution program for the environment watch to express the actions (or their images) of one person continuously in the display unit 54. By adopting this execution program for the environment watch, the user is enabled to know the time from the habitual action patterns. The user can correct the action pattern according to his taste and can simulate his own action pattern thereby to know the precise timing.

For example, moreover, it is possible to adopt the execution program for the environment watch to display the rotation (or its image) of the earth in the display unit 54. By adopting this execution program for the environment watch, the user is enabled to know the time of the global scale from the displayed contents of the display unit 54.

For example, moreover, it is possible to adopt the execution program for the environment watch to display the image of a predetermined sport and its lapse time in the display unit 54. By adopting this execution program for the environment watch, the user can is enabled to recognize the lapse time easily.

For example, moreover, it is possible to adopt the execution program for the environment watch to express the actual lapse time by displaying the images, in which the elapsing speed of phenomena having an actually long lapse time such as the behaviors of the evolution of an organism is accelerated, in the display unit 54.

For example, moreover, it is possible to adopt the execution program for the environment watch to express the actual lapse time by displaying the images, in which the phenomena shorter than the real time are delayed in the elapsing speed, in the display unit 54.

For example, moreover, it is possible to adopt the execution program for the environment watch, in which graphic changing information, various kinds of graphic changing patterns, or objects having defined actions are added (or can be added later).

Moreover, still another execution program for the environment watch can also be adopted by adopting the functional constitution of FIG. 18 in place of the example of FIG. 5 as the functional constitution of the wrist watch 1.

Specifically, FIG. 18 shows an example of the functional constitution of the wrist watch 1, to which the invention is applied, that is, an example different from that of FIG. 5. Here in the wrist watch 1 of the functional constitution example of FIG. 18, the portions corresponding to those of the functional constitution example of FIG. 5 are designated by the common reference numerals, and their description is suitably omitted.

In the example of FIG. 18, the wrist watch 1 is provided with not only the central processing unit 51 to the power supply unit 56 like those of the example of FIG. 5 but also the audio creation unit 151, the audio output unit 152, the sensor unit 153 and the communication unit 154.

In accordance with the audio creation command (or instruction) from the central processing unit 51, the audio creation unit 151 creates the audio data corresponding to the sound outputted from the audio output unit 152, and transfers the audio data in an analog signal mode to the audio output unit 152.

The audio output unit 152 is made of a speaker or a microphone, and outputs the sound corresponding to the audio data (or the analog signals) transferred from the audio creation unit 152.

The sensor unit 153 measures the level of the predetermined state of the wrist watch 1 itself and the atmosphere, and provides the central processing unit 51 with the data indicating the level, such as the data of atmospheric pressure or temperature.

The communication unit 154 relays the transfer of various kinds of information between the central processing unit 51 and the not-shown other devices by controlling the communications with the other devices.

In addition, the functional constitution example of FIG. 18 has the following differences, as compared with the functional constitution example of FIG. 5.

Specifically, the power supply unit 56 supplies the power source (or the electric power) not only to the central processing unit 51 through the display unit 54 but also to the audio creation unit 151, the audio output unit 152, the sensor unit 153 and the communication unit 154.

Moreover, the hardware constitution of the wrist watch 1 having the functional constitution of FIG. 18 is provided not only with the hardware constitution example of FIG. 2 but also with hardware blocks (or modules), although not shown, as corresponding to the audio creation unit 151, the audio output unit 152, the sensor unit 153, and the communication unit 154, respectively.

By adopting the wrist watch 1 having he functional constitution of the example of FIG. 18, the following execution program for the environment watch can also be adopted in addition to the aforementioned various kinds of execution programs for the environment watch.

For example, it is possible to adopt the execution program for the environment watch to change the weather in the display screen of the display unit 54 by making use of the weather information which has been acquired from the output by the communication unit 154. In case this execution program for the environment watch is adopted, the audio creation unit 151, the audio output unit 152 and the sensor unit 153 are not essential constitutional elements for the wrist watch 1 (or can be omitted).

For example, moreover, it is possible to adopt the execution program for the environment watch, to change the weather in the display screen of the display unit 54 according to the actual weather, by making use of the data such as the atmospheric pressure or temperature fetched by the sensor unit 153. In case this execution program for the environment watch is adopted, the audio creation unit 151, the audio output unit 152 and the communication unit 154 are not essential constitutional elements for the wrist watch 1 (or can be omitted).

For example, moreover, it is possible to adopt the execution program for the environment watch, to express the change in the environment not only in the display screen of the display unit 54 but also by the sound from the audio output unit 152. In case this execution program for the environment watch is adopted, the sensor unit 153 and the communication unit 154 are not essential constitutional elements for the wrist watch 1 (or can be omitted).

By installing the aforementioned various execution programs for the environment watch on the wrist watch 1, as has been described hereinbefore, it is possible to realize the watch which can express the time change with the various element changes. Here, the elements are those which constitute the display contents of the display unit 54 of the wrist watch 1 or the output contents of the audio output unit 152, and are the individual objects such as the mountain 89 in the virtual space in the example of FIG. 12.

Thus, it is possible to achieve the following various advantages.

Specifically, it is advantageous that the user can read out the various pieces of information on the time from the plural elements thereby to interpret the time in accordance with the actual life.

For example, it is also advantageous that the time display itself can be an enjoyable entertainment.

For example, moreover, the user can feel, even if invisibly enclosed (e.g., in a spaceship), the natural time flow and can match the action pattern. It is, therefore, advantageous that the user can keep the living rhythm even for a long life in the space.

For example, it is further advantageous that the user does not mistake the forenoon and the afternoon.

For example, it is further advantageous that the user can make various interpretations on the time such as not only the absolute time (or the current time) but also the lapse time or the residual time from the contents of the environment changes.

For example, it is further advantageous that a plurality of elements can be expressed all at once.

Figure 19:
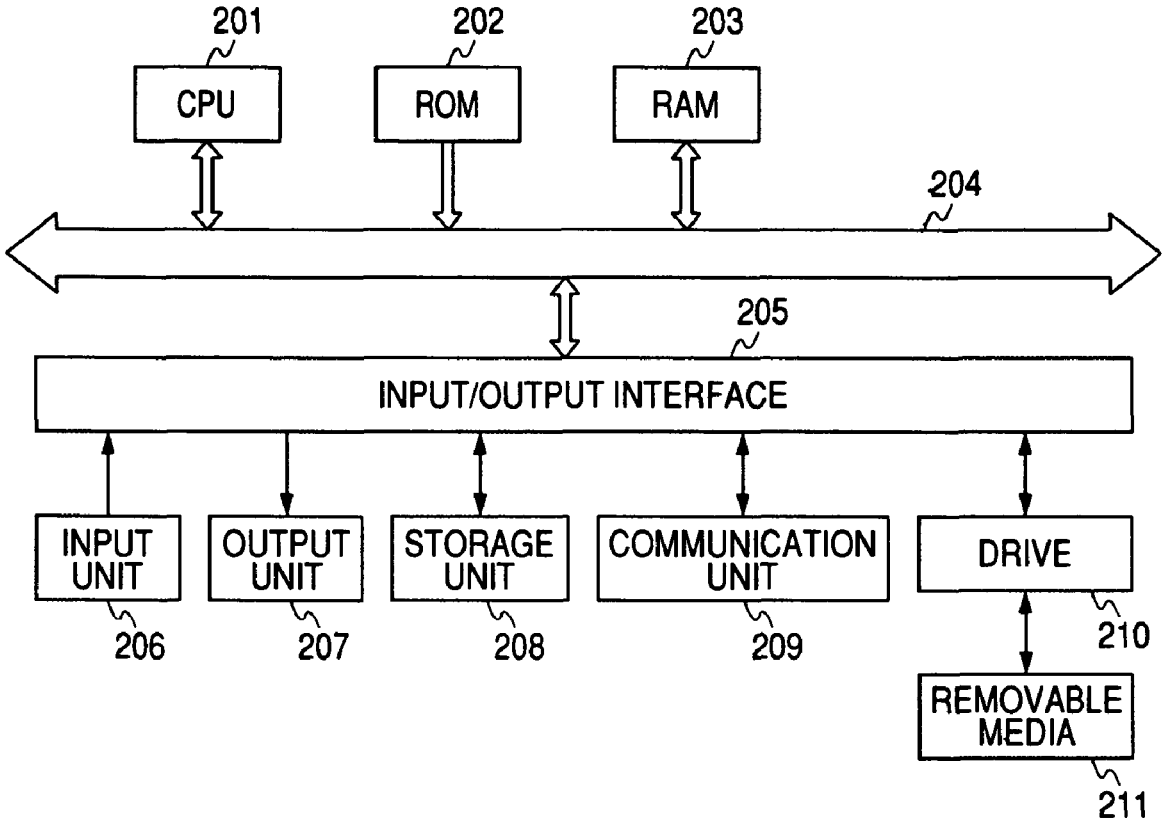
FIG. 19 is a block diagram showing an example of the constitution of a personal computer for executing a program according to an embodiment of the invention, such as an execution program for the environment watch.

Here, the various kinds of execution programs for the environment watch, which can achieve those various effects, can be executed not only by the wrist watch 1 but also by various machines such as game machines or the personal computer shown in FIG. 19.

In other words, the aforementioned series operations including the execution program for the environment watch of FIG. 17 can be executed by the software or by the hardware. In the case of the execution by the software, not only the wrist watch 1 but also the various information processing devices such as the game machine or the personal computer shown in FIG. 19 can be adopted as the information processing device to be executed.

FIG. 19 is a block diagram showing an example of the constitution of the personal computer for executing the aforementioned series operations.

In FIG. 19, a CPU (Central Processing Unit) 201 executes the various operations according to the program stored in a ROM (Read Only Memory) 202 or a storage unit 208. A RAM (Random Access Memory) 203 is suitably stored with a program (e.g., the execution program for the environment watch) to be executed by the CPU 201, and data. These CPU 201, the ROM 202 and the RAM 203 are mutually connected by a bus 204.

An input/output interface 205 is connected with the CPU 201 through the bus 204. With the input/output interface 205, there are connected an input unit 206 composed of a keyboard, a mouse or a microphone, and an output unit 207 composed of a display or a speaker. The CPU 201 executes various processing in response to the command inputted from the input unit 206. Moreover, the CPU 201 outputs the processed result to the output unit 207.

The storage unit 208, as connected with the input/output interface 205, is made of a hard disk, and stores the program to be executed by the CPU 201, and the various pieces of data. A communication unit 209 communicates with the external device through the network such as an internet or a local area network.

Alternatively, the program may be acquired through the communication unit 209 and may be stored in the storage unit 208.

A drive 210, as connected with the input/output interface 205, drives a removable media 211 such as a magnetic disk, an optical disk, a magneto-optic disk or a semiconductor memory, when mounted, to acquire the program or data recorded therein. The program and data acquired is transferred to and stored in the storage unit 208, if needed so.

Moreover, the drive 210 can also drive the removable media 211, when loaded, to record the data therein.

A program recording media, which is installed in a computer for storing the program to be executed by the computer, is constituted, as shown in FIG. 19, to include the removable media 211 or the package media composed of a magnetic disk (including a flexible disk), an optical disk (including a CD-ROM (Compact Disc—Read Only Memory) and a DVD (Digital Versatile Disc)), a magneto-optic disk or a semiconductor memory, the ROM 202 for storing the program temporarily or perpetually, or the hard disk constituting the storage unit 208. The storage of the program in the program recording media is performed, if necessary, by utilizing the wired or wireless communication media such as the local area network, the internet or the digital satellite broadcasting, through the communication unit 209 or the interface such as a router or a modem.

Herein, the step of describing the program stored in the program recording media contains not only the operations to be performed on the time-series of the described order but also the operations which are not always performed on the time-series but in parallel or individually.

It should be understood by those skilled in the art that various modifications, combinations, sub-combinations and alterations might occur depending on design requirements and other factors insofar as they are within the scope of the appended claims or the equivalents thereof.

What is claimed is:

1. An information processing device comprising:

timing means for performing a timing action and outputting time information indicating a result of the timing action;

unit time outputting means for converting the time information into individual time units, each individual time unit being associated with a type, the type having at least two possible time values;

unit-by-unit contents decision means for determining unit presentation contents of a non-alpha-numeric object, wherein parameter values are individually designated for all possible time values of every type of the individual time units, the parameter values for at least one type of the individual time units differing from the time values of their corresponding time units, wherein the unit-by-unit contents decision means determines the parameter values for the unit presentation contents of the non-alpha-numeric object for each one of the individual time units;

general contents decision means for determining general presentation contents of the non-alpha-numeric object at a time indicated by the time information based on the unit presentation contents, wherein determining the general presentation contents comprises:

calculating a sum of the parameter values of the unit presentation contents of the non-alpha-numeric object; and determining the general presentation contents of the object based on the sum; and presentation means for presenting the non-alpha-numeric object based on the general presentation contents.

2. An information processing device according to claim 1, wherein the information processing device further comprises storage means for storing individual tables for the types of the individual time units indicating corresponding relations between the possible time values of one of the types of the individual time units and parameter values corresponding to the possible time values, wherein the unit-by-unit contents decision means determines the parameter values based on the individual tables, and wherein the general contents decision means performs predetermined operations to use the parameter values for the every one of the individual time units and determines the general presentation contents based on results of the predetermined operations.

3. An information processing device according to claim 2, wherein the parameter values correspond to different colors or chroma.

4. An information processing device according to claim 1, wherein the non-alpha-numeric object is one of a plurality of non-alpha-numeric objects, wherein the unit-by-unit-contents decision means and the general contents decision means execute individual operations on the plurality of non-alpha-numeric objects, and wherein the presentation means presents the plurality of non-alpha-numeric objects individually with the general presentation contents which are individually determined by the general contents decision means for each one of the plurality of non-alpha-numeric objects.

5. An information processing device according to claim 4, wherein the plurality of non-alpha-numeric objects are individual images, and wherein the presentation means presents one image with the plurality of non-alpha-numeric objects as constituent elements.

6. An information processing device according to claim 1, further comprising sensor means for measuring a level of a predetermined state of the information processing device or current environment of the information processing device, wherein at least one of the unit-by-unit contents decision means and the general contents decision means corrects the unit presentation contents or the general presentation contents in response to the level.

7. An information processing device according to claim 6, wherein the sensor means measures at least one of atmospheric pressure or temperature.

8. An information processing device according to claim 1, further comprising communication means for communicating with a different information processing device, wherein at least one of the unit-by-unit contents decision means and the general contents decision means corrects the unit presentation contents or the general presentation contents in response to information obtained from the different information processing device.

9. An information processing device according to claim 8, wherein the information is weather information, wherein the presentation means changes weather presented based on the weather information.

10. An information processing device according to claim 1, wherein types of the individual time units comprise at least one of year time, month time, four-season time, day, day time, half day time, hour time, minute time, and second time.

11. An information processing device according to claim 1, wherein the non-alpha-numeric object is an image representing a physical object.

12. An information processing device according to claim 1, wherein the individual time units comprise four season time, and wherein the all possible time values of the four season time are spring, summer, autumn, and winter.

13. An information processing device according to claim 1, wherein the sum is different from a second sum based on any other combination of parameter values.

14. A wrist watch comprising:

a display;

a microcomputer for performing a timing action and outputting time information indicating a result of the timing action;

a processor for:

converting the time information into individual unit times, each individual time unit being associated with a type, the type having at least two possible time values, determining the unit presentation contents of a non-alpha-numeric object, wherein parameter values are individually designated for all possible time values of every type of the individual time units, the parameter values for at least one type of the individual time units differing from the time values of their corresponding time units, wherein determining the unit presentation contents comprises determining the parameter values for the unit presentation contents of the non-alpha-numeric object for each one of the individual time units, and determining general presentation contents of the non-alpha-numeric object at a time indicated by the time information based on the unit presentation contents, wherein determining the general presentation contents comprises:

calculating a sum of the parameter values of the unit presentation contents of the non-alpha-numeric object; and determining the general presentation contents of the object based on the sum;

a three-dimensional computer graphics engine for creating graphic data based on the general presentation contents; and a display controller for presenting the non-alpha-numeric object in the display based on the graphic data.

15. A wrist watch according to claim 14, wherein the three-dimensional computer graphics engine utilizes curve faced architecture method to generate the graphic data.

16. A wrist watch according to claim 14, wherein the microcomputer comprises an oscillation circuit or a counter.

17. A wrist watch according to claim 14, wherein the three-dimensional computer graphics engine controls the display using morphing to deform a first numeral representing all or part of a first actual time value of a first individual time unit of the individual time units into a second numeral representing all or part of a second actual time value of the first individual time unit.

18. An information processing method, comprising:

performing a timing action;

outputting time information indicating a result of the timing action;

converting the time information into individual time units, each individual time unit being associated with a type, the type having at least two possible time values;

determining unit presentation contents of non-alpha-numeric object, wherein parameter values are individually designated for all possible time values of every type of the individual time units, the parameter values for at least one type of the individual time units differing from the time values of their corresponding time units, wherein determining the unit presentation contents comprises determining the parameter values for the unit presentation contents of the non-alpha-numeric object for each one of the individual time units;

determining general presentation contents of the non-alpha-numeric object at a time indicated by the time information, based on the unit presentation contents, wherein determining the general presentation contents comprises:

calculating a sum of the parameter values of the unit presentation contents of the non-alpha-numeric object; and determining the general presentation contents of the object based on the sum; and presenting the non-alpha-numeric object based on the general presentation contents.

19. An information processing method according to claim 18, wherein at least one of the possible time values of one of the individual time units comprises a changing unit, and wherein determining the parameter values for the unit presentation contents of the non-alpha-numeric object occurs only when the time information indicating the result of the timing action is comprised of the changing unit.

20. A computer readable media storing a program for causing a computer to execute a method for controlling a device, the method comprising:

performing a timing action;

outputting time information indicating a result of the timing action;

converting the time information into individual time units, each individual time unit being associated with a type, the type having at least two possible time values;

determining unit presentation contents of a non-alpha-numeric object, wherein parameter values are individually designated for all possible time values of every type of the individual time units, the parameter values for at least one type of the individual time units differing from the time values of their corresponding time units, wherein determining the unit presentation contents comprises determining the parameter values for the unit presentation contents of the non-alpha-numeric object for each one of the individual time units;

determining general presentation contents of the non-alpha-numeric object at a time indicated by the time information, based on the unit presentation contents, wherein determining the general presentation contents comprises:

calculating a sum of the parameter values of the unit presentation contents of the non-alpha-numeric object; and determining the general presentation contents of the object based on the sum; and presenting the object non-alpha-numeric based on the general presentation contents.

* * * * *